US008265531B2

(12) United States Patent
Mizutani et al.

(10) Patent No.: US 8,265,531 B2
(45) Date of Patent: Sep. 11, 2012

(54) IMAGE FORMING APPARATUS THAT DETECTS IMAGE SHIFT IN THE MAIN SCANNING DIRECTION WITHOUT WASTING TONER

(75) Inventors: Yuri Mizutani, Kawasaki (JP); Ichiro Okumura, Abiko (JP); Isao Hayashi, Kawasaki (JP)

(73) Assignee: Canon Kabushiki Kaisha (JP)

( * ) Notice: Subject to any disclaimer, the term of this patent is extended or adjusted under 35 U.S.C. 154(b) by 167 days.

(21) Appl. No.: 12/705,156

(22) Filed: Feb. 12, 2010

(65) Prior Publication Data

US 2010/0209124 A1 Aug. 19, 2010

(30) Foreign Application Priority Data

Feb. 13, 2009 (JP) ..... 2009-031321
Feb. 10, 2010 (JP) ..... 2010-027605

(51) Int. Cl.
*G03G 15/01* (2006.01)

(52) U.S. Cl. ..... 399/301

(58) Field of Classification Search ..... 399/72, 399/297–303, 308; 347/14, 16, 153, 154, 347/232

See application file for complete search history.

(56) References Cited

U.S. PATENT DOCUMENTS 6,393,244 B1 5/2002 Nakayasu et al.
7,581,803 B2 * 9/2009 Shinohara ..... 347/16
7,586,510 B2 * 9/2009 Maeda ..... 347/232

FOREIGN PATENT DOCUMENTS

JP 64-006981 A 1/1989
JP 2001-083856 A 3/2001

* cited by examiner

*Primary Examiner* — Hoan Tran
(74) *Attorney, Agent, or Firm* — Rossi, Kimms & McDowell LLP

(57) ABSTRACT

An image forming apparatus which is capable of detecting the direction and amount of an image shift in the main scanning direction without wasting toner, to thereby provide a higher-quality image with reduced running costs. A conductor is disposed such that the conductor partially overlaps an electrostatic latent image line formed on a photosensitive drum in a manner extending in a main scanning direction of the photosensitive drum, while moving relative to the electrostatic latent image line. The conductor generates induced current by the relative motion. An image shift in the main scanning direction is detected based on a result of measurement of the induced current generated by the conductor.

16 Claims, 38 Drawing Sheets

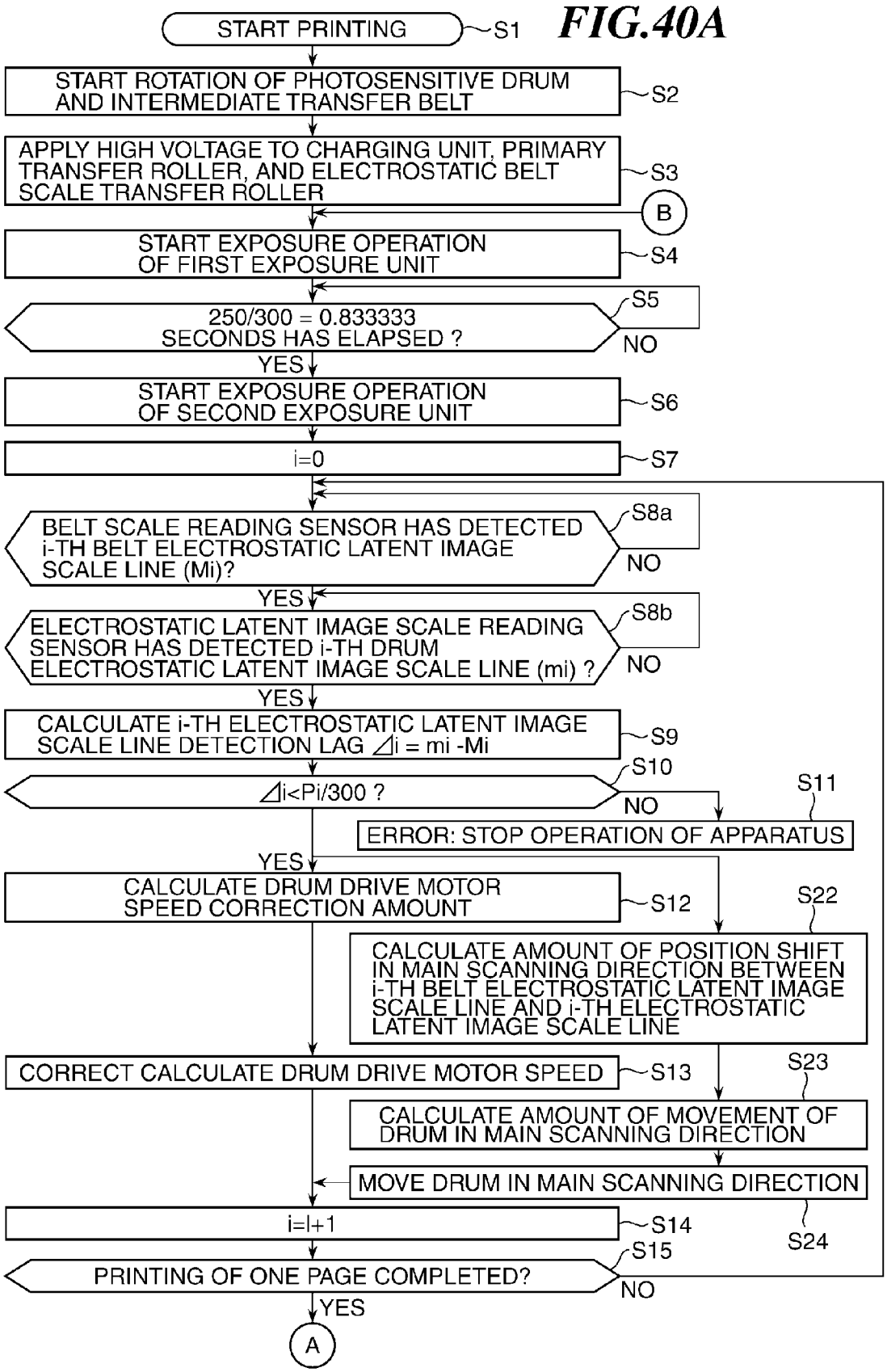
FIG.40A
START PRINTING
S1
START ROTATION OF PHOTOSENSITIVE DRUM AND INTERMEDIATE TRANSFER BELT
S2
APPLY HIGH VOLTAGE TO CHARGING UNIT, PRIMARY TRANSFER ROLLER, AND ELECTROSTATIC BELT SCALE TRANSFER ROLLER
S3
B
START EXPOSURE OPERATION OF FIRST EXPOSURE UNIT
S4
250/300 = 0.833333 SECONDS HAS ELAPSED ?
S5
NO
YES
START EXPOSURE OPERATION OF SECOND EXPOSURE UNIT
S6
i=0
S7
BELT SCALE READING SENSOR HAS DETECTED i-TH BELT ELECTROSTATIC LATENT IMAGE SCALE LINE (Mi)?
S8a
NO
YES
ELECTROSTATIC LATENT IMAGE SCALE READING SENSOR HAS DETECTED i-TH DRUM ELECTROSTATIC LATENT IMAGE SCALE LINE (mi) ?
S8b
NO
YES
CALCULATE i-TH ELECTROSTATIC LATENT IMAGE SCALE LINE DETECTION LAG ⊿i = mi -Mi
S9
⊿i<Pi/300 ?
S10
NO
S11
ERROR: STOP OPERATION OF APPARATUS
YES
CALCULATE DRUM DRIVE MOTOR SPEED CORRECTION AMOUNT
S12
S22
CALCULATE AMOUNT OF POSITION SHIFT IN MAIN SCANNING DIRECTION BETWEEN i-TH BELT ELECTROSTATIC LATENT IMAGE SCALE LINE AND i-TH ELECTROSTATIC LATENT IMAGE SCALE LINE
CORRECT CALCULATE DRUM DRIVE MOTOR SPEED
S13
S23
CALCULATE AMOUNT OF MOVEMENT OF DRUM IN MAIN SCANNING DIRECTION
MOVE DRUM IN MAIN SCANNING DIRECTION
S24
i=I+1
S14
PRINTING OF ONE PAGE COMPLETED?
S15
NO
YES
A

IMAGE FORMING APPARATUS THAT DETECTS IMAGE SHIFT IN THE MAIN SCANNING DIRECTION WITHOUT WASTING TONER

BACKGROUND OF THE INVENTION

1. Field of the Invention

The present invention relates to an image forming apparatus for forming an image on a sheet, and more particularly to an image forming apparatus characterized by a color shift detection technique.

2. Description of the Related Art

A conventional electrophotographic color image forming apparatus has a photosensitive drum for carrying toner images and sequentially transfers the toner images in respective different colors onto an intermediate transfer belt or a sheet held on a conveyor belt to thereby form a color image.

However, when the speed of rotation of the photosensitive drum or the intermediate transfer belt changes due to insufficient mechanical accuracy or the like, causing a change in the positional relationship in the transfer position of each color between the photosensitive drum and the intermediate transfer belt, toner images in the respective different colors cannot be perfectly superimposed one upon another. In short, so-called color shift (image shift) occurs.

To solve this problem, an image forming apparatus proposed in Japanese Patent Laid-Open Publication No. S64-6981 employs a method in which a visible image as a position detection mark is formed by each of color-specific image forming units, and the position detection mark transferred onto a traveling member is detected by an associated sensor, whereafter the image forming units are controlled based on detection signals output from the respective sensors so as to correct an image shift.

The above-mentioned proposal makes it possible to correct color shift that occurs after the lapse of a long time period due to a change in the position and size of an image forming unit or the position and size of a component part in an image forming unit, which are caused by changes in the temperature within the color image forming apparatus.

However, it is required to use toner to form the position detection marks, which results in waste of toner.

To overcome the problem, there has been proposed an image forming apparatus in Japanese Patent Laid-Open Publication No. 2001-83856, which detects electrostatic latent image marks written at predetermined intervals on a color-by-color basis on an image carrier having a surface thereof formed of a dielectric material, and controls the speed of rotation of the image carrier based on detection values.

According to this method, since electrostatic latent images are used as position detection marks, it is possible to prevent waste of toner.

However, in the method disclosed in Japanese Patent Laid-Open Publication No. 2001-83856, only color shift in the sub scanning direction is detected, but color shift in the main scanning direction cannot be detected at the same time. Therefore, it is impossible to correct color shift in the main scanning direction.

SUMMARY OF THE INVENTION

The present invention provides an image forming apparatus which is capable of detecting the direction and amount of image shift in the main scanning direction without wasting toner, to thereby provide higher-quality images with reduced running costs.

In a first aspect of the present invention, there is provided an image forming apparatus comprising a conductor disposed such that said conductor partially overlaps an electrostatic latent image line formed on an image carrier in a manner extending in a main scanning direction of the image carrier, while performing relative motion to the electrostatic latent image line, said conductor being configured to generate induced current by the relative motion, and a detection unit configured to detect image shift in the main scanning direction based on a result of measurement of the induced current generated by said conductor.

In a second aspect of the present invention, there is provided an image forming apparatus comprising a first conductor disposed in parallel to a first electrostatic latent image line formed on an image carrier in parallel with a main scanning direction of the image carrier, and a second conductor disposed in parallel to a second electrostatic latent image line formed on the image carrier obliquely in the main scanning direction, wherein induced current is generated by moving said conductors relative to the respective electrostatic latent image lines, and image shifts in the main scanning direction and a sub scanning direction are detected based on a phase difference between a first output signal from said first conductor and a second output signal from said second conductor.

In a third aspect of the present invention, there is provided an image forming apparatus comprising a rotatable image carrier on which an electrostatic latent image line is formed, a detection unit configured to detect a signal that changes according to a position where the electrostatic latent image line is formed in a main scanning direction orthogonal to a sub scanning direction in which said image carrier performs rotation, and a correction unit configured to correct a position shift of an image formed on said image carrier in the main scanning direction, based on the signal detected by said detection unit.

In a fourth aspect of the present invention, there is provided an image forming apparatus comprising a rotatable image carrier on which an electrostatic latent image line is formed, a conductor disposed such that said conductor partially overlaps the electrostatic latent image line formed on said image carrier, said conductor being configured to generate induced current that changes according to a position in a main scanning direction orthogonal to a sub scanning direction in which said image carrier performs rotation, where the electrostatic latent image line is formed, a detection unit configured to detect the induced current generated in said conductor, and a correction unit configured to correct a position shift of an image formed on said image carrier, in the main scanning direction, based on the induced current detected by said detection unit.

According to the present invention, it is possible to clearly grasp objects to be controlled, by detecting the direction and amount of image shift simultaneously in the main scanning direction and in the sub scanning direction without wasting toner, separately in each image forming unit, to thereby obtain a higher-quality image.

Further features of the present invention will become apparent from the following description of exemplary embodiments (with reference to the attached drawings).

BRIEF DESCRIPTION OF THE DRAWINGS

FIGS. 40A and 40B are a flowchart of a color shift control process executed using a main-scan color shift correction method and the sub-scan color shift correction method.

DETAILED DESCRIPTION OF THE EMBODIMENTS

The present invention will now be described in detail below with reference to the accompanying drawings showing embodiments thereof.

Figure 30:
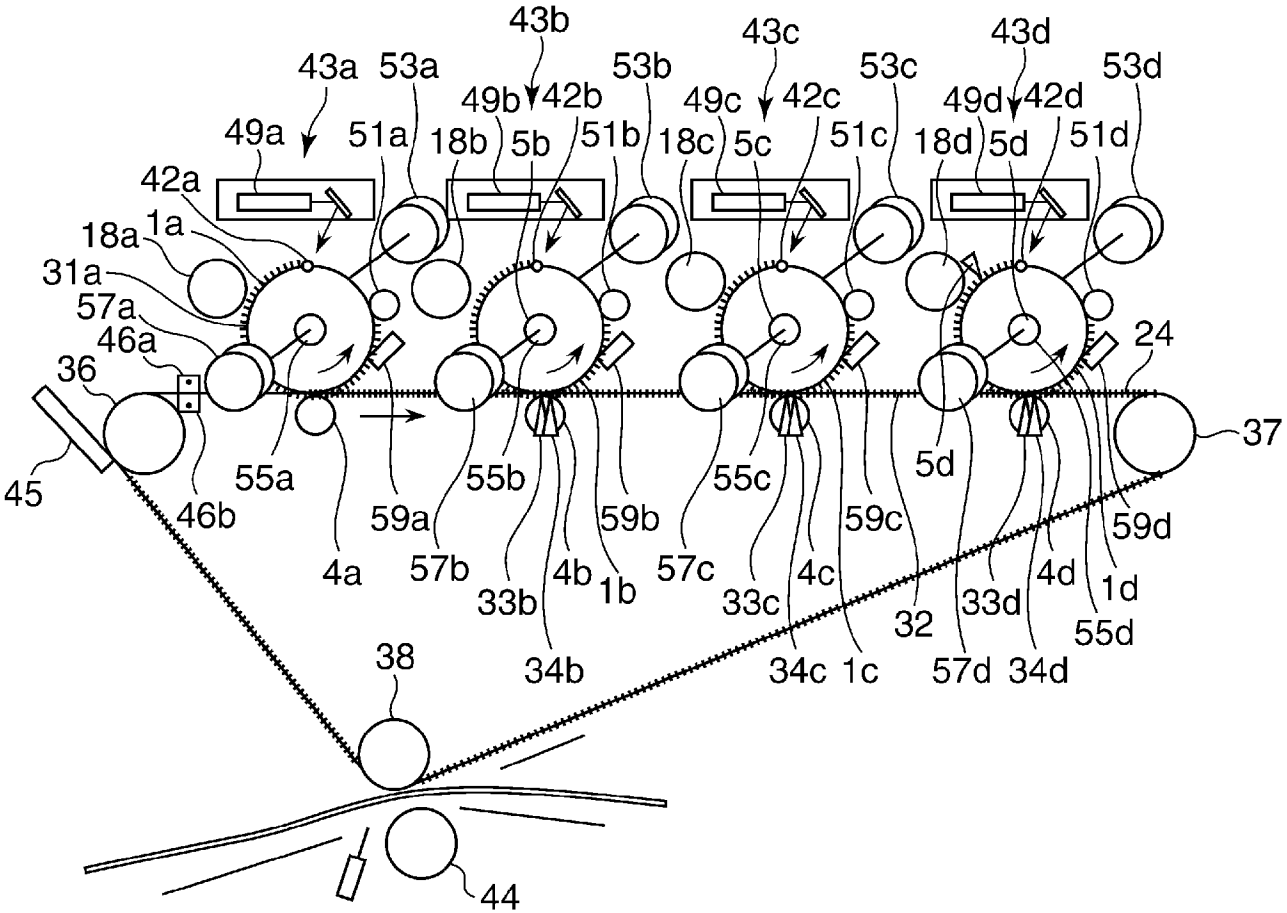
FIG. 30 is a front view of essential parts of the image forming apparatus.
Figure 31:
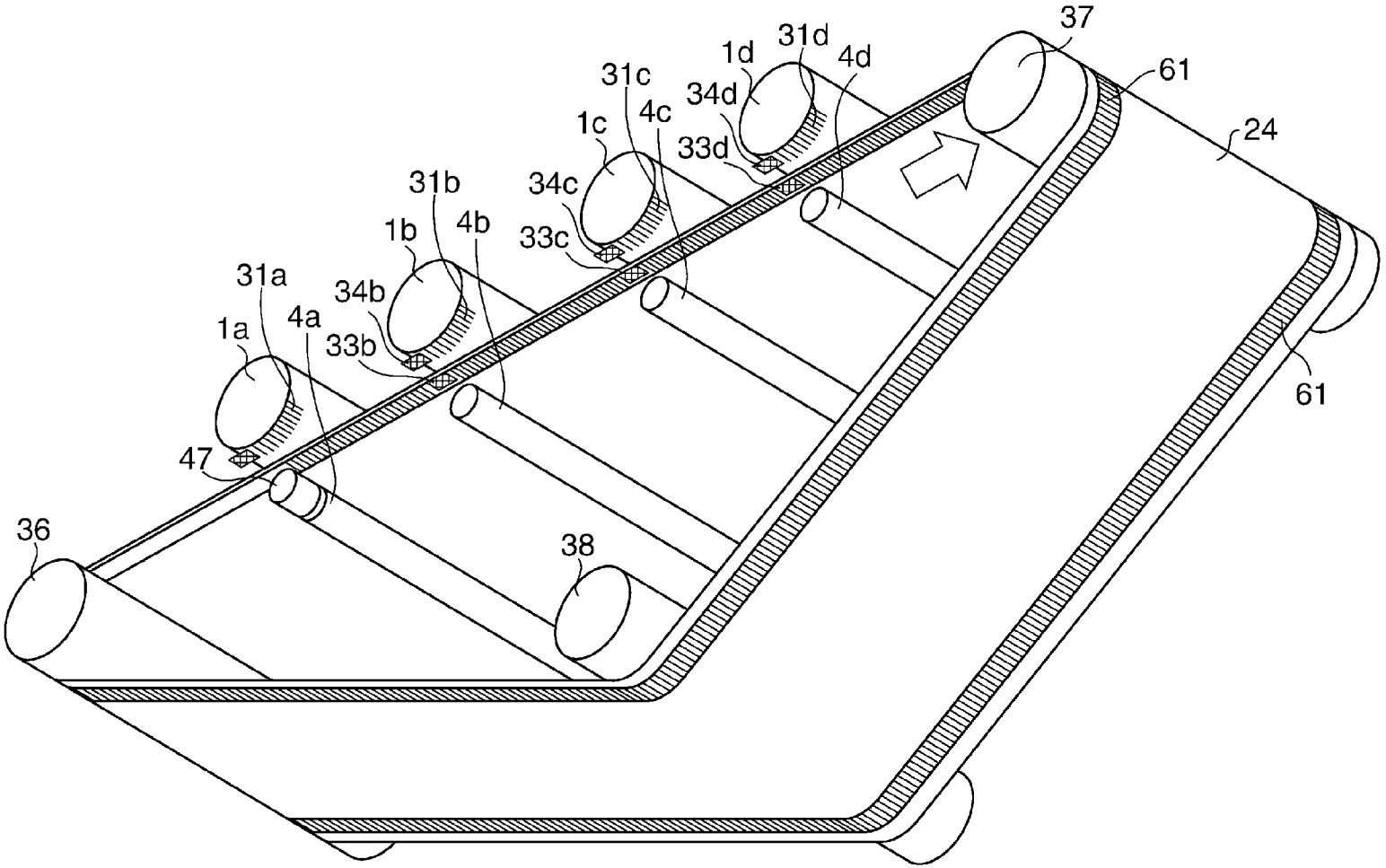
FIG. 31 is a perspective view of the essential parts of the image forming apparatus.
Figure 32:
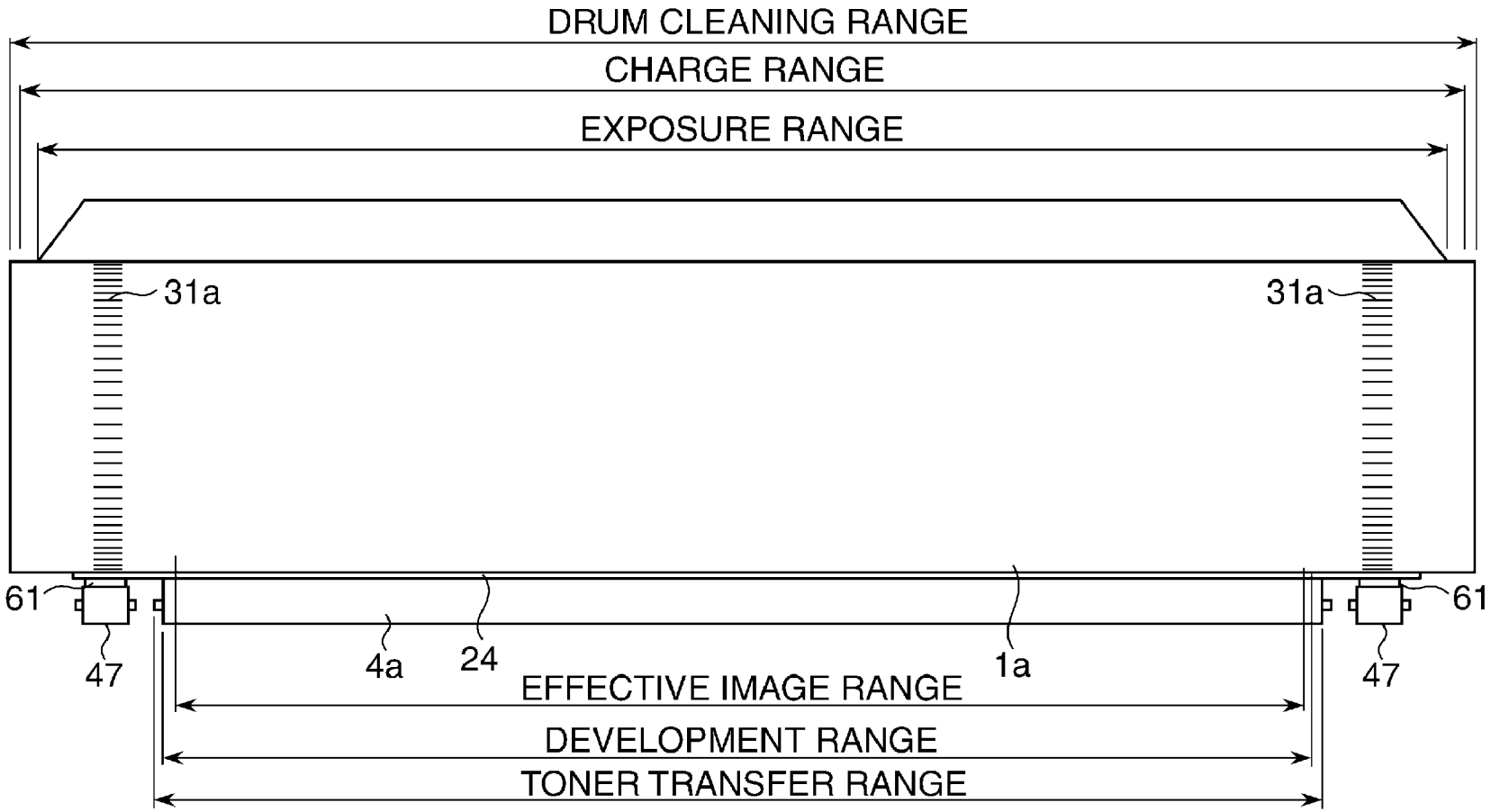
FIG. 32 is a side view of a first image forming unit of the image forming apparatus, as viewed from upstream in a belt conveying direction.
Figure 33:
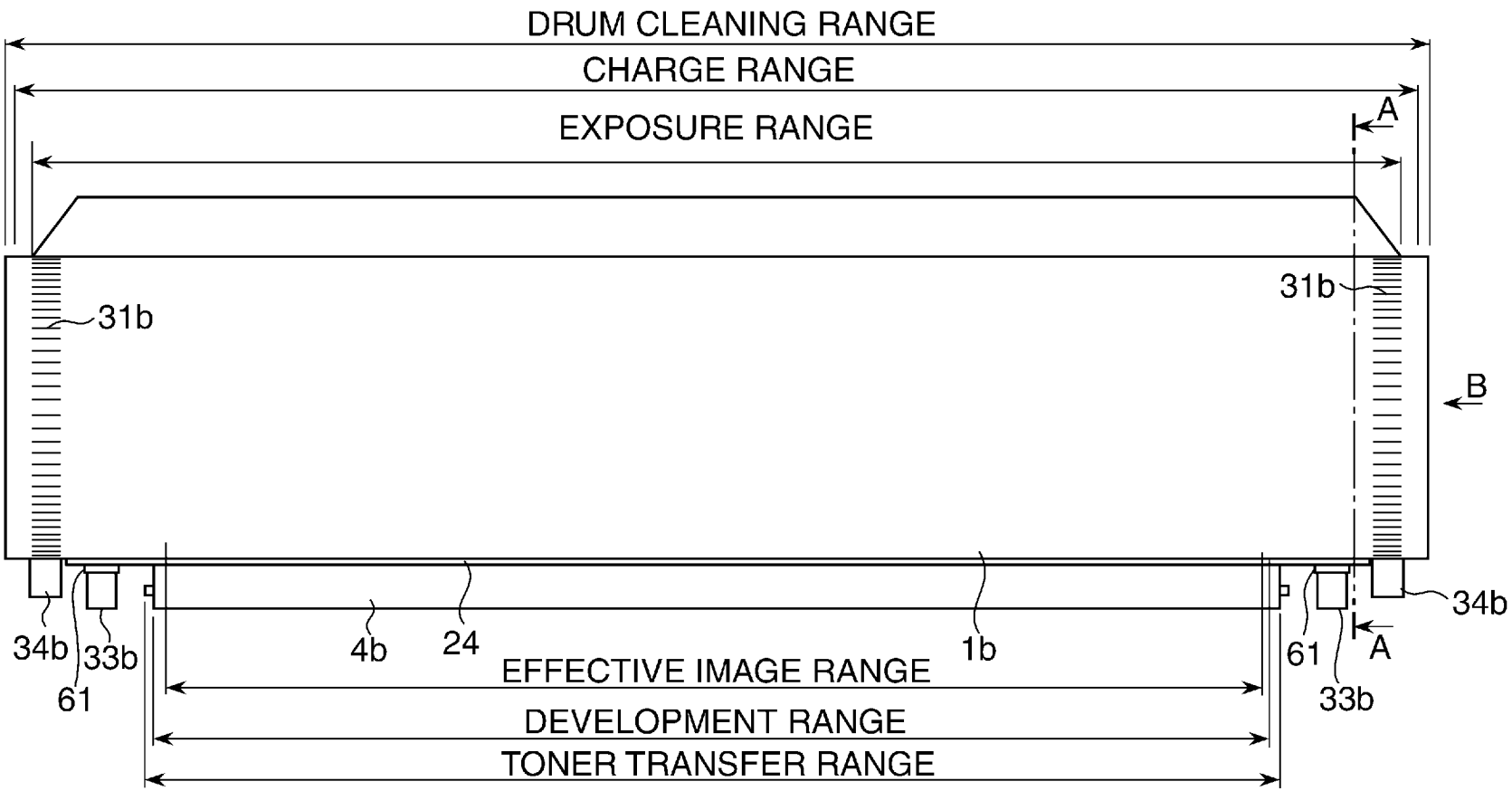
FIG. 33 is a side view of a second image forming unit of the image forming apparatus, as viewed from upstream in the belt conveying direction.
Figure 34:
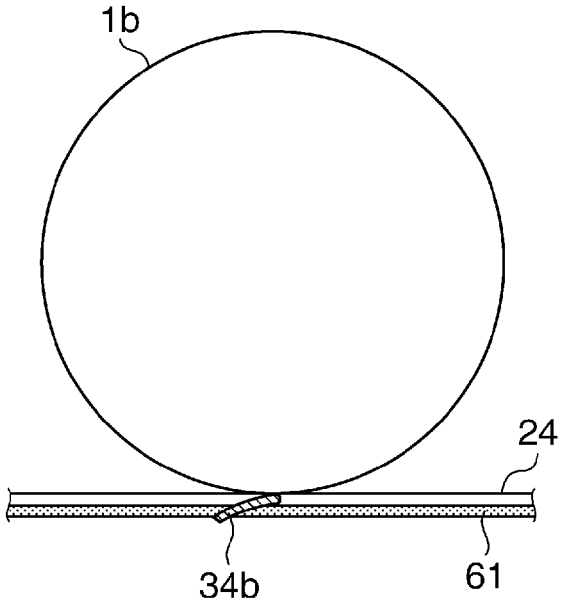
FIG. 34 is a side view of the second image forming unit as viewed in a direction indicated by an arrow B in FIG. 33.
Figure 35:
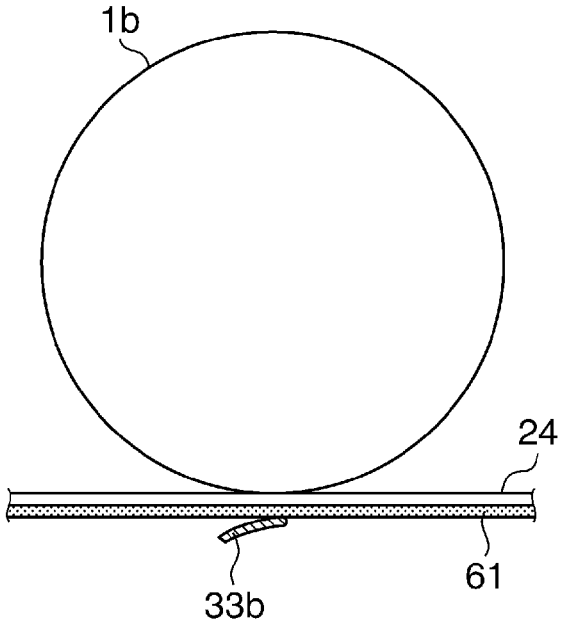
FIG. 35 is a cross-sectional view of the second image forming unit taken along line A-A in FIG. 33.

FIGS. 1A and 1B to 4A and 4B and FIGS. 30 to 40 are views and diagrams useful in explaining an image forming apparatus according to a first embodiment of the present invention. FIG. 30 is a front view of essential parts of the image forming apparatus, and FIG. 31 is a perspective view of the essential parts of the same. FIGS. 32 and 33 are side views of a first image forming unit and a second image forming unit, as viewed from upstream in a belt conveying direction. FIGS. 34 and 35 are views of a photosensitive drum, an intermediate transfer belt and a sensor in the second image forming unit, which are useful in explaining details of the arrangement thereof. It should be noted that a plurality of members or components denoted by respective reference numerals formed by a same numeral and respective different alphabetical suffixes are collectively denoted by the numeral, as deemed appropriate.

Conventionally, in a tandem image forming apparatus, four or more photosensitive drums 1*a*, 1*b*, 1*c*, and 1*d* are arranged on a single intermediate transfer belt 24, as shown in FIGS. 30 and 31, to form images in respective different colors (yellow (Y), magenta (M), cyan (C), and black (Bk)).

An arrangement for forming a color toner image on the intermediate transfer belt 24 and transferring the formed image on a recording medium will be described with reference to FIGS. 30 and 31. The intermediate transfer belt 24 is wound around at least three rollers, i.e. a belt driving roller 36 for applying a rotational driving force to the intermediate transfer belt 24, a belt driven roller 37, and a secondary transfer roller 38, and the belt driven roller 37 or the secondary transfer roller 38 applies a predetermined tension to the intermediate transfer belt 24. A belt cleaner 45 is disposed close to the belt driving roller 36 to neatly clean the surface of the intermediate transfer belt 24 by scraping off toner left attached to the belt surface without being transferred to the recording medium.

As shown in FIG. 30, an upper corona charger 46*a* and a lower corona charger 46*b* are disposed between the belt driving roller 36 and a first photosensitive drum 12*a* in a manner sandwiching transfer sections 61 on the intermediate transfer belt 24. AC voltages with opposite phases are applied to the respective corona chargers 46*a* and 46*b*, whereby electrostatic belt scales 32 on the respective transfer sections 61 are positively erased. Alternatively, earthed discharge brushes, not shown, may be disposed at opposite lateral ends of the belt cleaner 45 at respective locations opposed to the transfer sections 61 provided on the intermediate transfer belt 24 such that the discharge brushes are held in contact with the respective transfer sections 61, whereby the electrostatic belt scales 32 transferred on the respective transfer sections 61 may be erased.

Next, the arrangement of an image forming unit (43*a*, 43*b*, 43*c*, 43*d*) will be described with reference to FIG. 30.

Reference numeral 1*a* denotes the first photosensitive drum provided in the first image forming unit 43*a*. The first photosensitive drum 1*a* receives a driving force via a drive system provided on a rear side, as viewed in FIG. 30, of the first image forming unit 43*a*, for transmitting a driving force from a drum drive motor 53*a* to a drum rotating shaft 55*a*. A drum encoder 57*a* implemented by a rotary encoder is coupled to the drum rotating shaft 55*a* disposed on a front side, as viewed in FIG. 30, of the first image forming unit 43*a*. In the first image forming unit 43*a*, the drum drive motor 53*a* is constantly rotated based on an output signal from the drum encoder 57*a*, whereby the photosensitive drum 1*a* is controlled to perform rotation at a constant angular velocity in a direction indicated by an arrow (i.e. a counterclockwise direction as viewed in FIG. 30).

In the present embodiment, each photosensitive drum is formed by an OPC photosensitive member with a photosensitive layer having a film thickness of 30 μm. In the case of forming a toner image on the surface of the photosensitive drum 1*a*, the photosensitive member on the surface of the photosensitive drum 1*a* is uniformly negatively charged with approximately −600 V by a charging unit 51*a*, and the surface potential of a portion irradiated with a laser beam is changed to approximately −100 V by applying the laser beam in a scanning fashion using a first exposure unit 49*a* according to an image signal, to thereby form an electrostatic latent image. At this time, as shown in FIG. 32, at locations on straight line extensions from an exposure position 42*a* of the photosensitive drum 1*a*, electrostatic latent image scale lines 31*a* are written on respective opposite end portions outside an effective image area by irradiation of the laser beam before and after image writing. Formation of the electrostatic latent image scale lines 31*a* is started immediately after the first photosensitive drum 1*a* starts rotation before writing of an image on the photosensitive drum 1*a*, and writing of the electrostatic latent image scale lines 31*a* is continued until completion of image formation on the first photosensitive drum 1*a*. Each electrostatic latent image scale line 31*a* is approximately 5 mm long in the axial direction of the photosensitive drum 1*a*. When the resolution of an image in the sub scanning direction is 1200 dpi, the electrostatic latent image scale lines 31*a* are formed at a pitch of 42.3 μm obtained by the following calculation:

$$25.4 \div 1200 \times 2 = 0.0423333 \ldots \text{mm}.$$

Yellow (Y) toner negatively charged by a development unit 18*a* is attached to the effective image area portion having the surface potential changed to approximately −100 V by irradiation of the laser beam, to form a first image (yellow (Y)). At this time, a development area for development by a development device 18 is defined, as shown in FIG. 32, such that the electrostatic latent image scale lines 31*a* at the opposite ends of the photosensitive drum 1*a* are prevented from being developed by toner.

Then, in a first transfer section where the first photosensitive drum 1*a* and the intermediate transfer belt 24 come into contact with each other, the Y toner forming the first image is transferred onto the intermediate transfer belt 24 by a positive electric field of approximately +1000 V which is applied by a primary transfer roller 4*a* having a diameter of approximately 16 mm and a surface thereof formed of conductive sponge. At this time, as shown in FIG. 32, the electrostatic latent image scale lines 31*a* come into contact with the transfer sections 61 formed on the respective opposite ends of the surface of the intermediate transfer belt 24 at respective locations corresponding to the electrostatic latent image scale lines 31*a* formed on the photosensitive drum 1*a*. Further, part of electric charge forming the electrostatic latent image scale lines 31*a* is transferred onto the transfer sections 61 by applying a high voltage of approximately +500 V using electrostatic belt scale transfer rollers 47 provided on the respective opposite sides of the primary transfer roller 4*a*, whereby the electrostatic belt scales 32 having marks arranged at the same pitch as that of the electrostatic latent image scale lines 31*a* are formed as shown in FIG. 31. At this time, a potential difference between the exposed portions where the respective electrostatic latent image scale lines 31*a* are formed and the electrostatic belt scale transfer rollers 47 is approximately 600 V, whereas a potential difference between non-exposed portions between the electrostatic latent image scale lines 31*a* and the electrostatic belt scale transfer rollers 47 is approximately 1100 V. The difference between the two potential differences varies a state of discharge between the photosensitive drum 1*a* and the intermediate transfer belt 24 or a state of discharge between the intermediate transfer belt 24 and the primary transfer roller 4*a*, whereby the electrostatic latent image scales are transferred onto the intermediate transfer belt 24. It is proved by experiment that in a case where the volume resistivity of the intermediate transfer belt 24 is approximately $10^{10}$ Ω·cm and a transfer section 61, described hereinafter, is formed of a material having a volume resistivity of $10^{14}$ Ω·cm or more as in the present embodiment, the surface potential of the transfer section after transfer is approximately +0 V at portions corresponding to electrostatic latent image formed portions irradiated with the laser beam, and is +50 V at portions corresponding to portions not irradiated with the laser beam. That is, a scale line on the photosensitive drum formed by a difference in surface potential between −600V to −100V is transferred onto the intermediate transfer belt, as a scale line formed by a difference in surface potential between +50 V and +0 V.

Next, a description will be given of the second to fourth image forming units 43*b* to 43*d*. The second to fourth image forming units 43*b* to 43*d* are identical in arrangement, and therefore only the second image forming unit 43*b* will be described. FIG. 33 is a view of the second image forming unit 43*b* as viewed from upstream in the belt conveying direction. FIG. 34 is a view of the second image forming unit 43*b* as viewed in a direction indicated by an arrow B in FIG. 33, and FIG. 35 is a cross-sectional view taken along line A-A in FIG. 33. In FIGS. 34 and 35, a primary transfer roller 4*b* is not shown.

In the second image forming unit 43*b*, the photosensitive drum 1*b* having the same shape as that of the photosensitive drum 1*a* of the image forming unit 43*a* is used, and belt scale reading sensors 33*b* are disposed inside the intermediate transfer belt 24 to detect the electrostatic belt scales 32 as electrostatic latent images transferred onto the respective transfer sections 61, from the reverse side of the intermediate transfer belt 24.

Further, as shown in FIG. 33, similarly to the photosensitive drum 1*a* of the first image forming unit 43*a*, the second photosensitive drum 1*b* has electrostatic latent image scale lines 31*b* formed on each of the opposite ends thereof at locations within an exposure range and outward of the respective opposite lateral ends of the intermediate transfer belt 24, simultaneously with formation of an image by the second image forming unit 43*b*. Further, as shown in FIG. 34, electrostatic latent image scale reading sensors 34*b* are disposed below the second photosensitive drum 1*b* such that they read the electrostatic latent image scale lines 31*b* at respective positions on straight line extensions imaginarily extended outward from a transfer position (transfer line) where transfer of a toner image is performed by contact between the second photosensitive drum 1*b* and the intermediate transfer belt 24.

Thus, in the second image forming unit 43*b*, the belt scale reading sensors 33*b* and the electrostatic latent image scale reading sensors 34*b* are arranged on the same transfer line, so that the electrostatic latent image scale lines 31*b* on the photosensitive drum 1*b* and the electrostatic belt scales 32 transferred onto the respective transfer sections 61 provided on the intermediate transfer belt 24 can be read simultaneously.

Next, actual image alignment, i.e. an operation for calibration by the second image forming unit 43*b* and the following image forming units will be described with reference to FIGS. 30 to 39.

Figure 36:
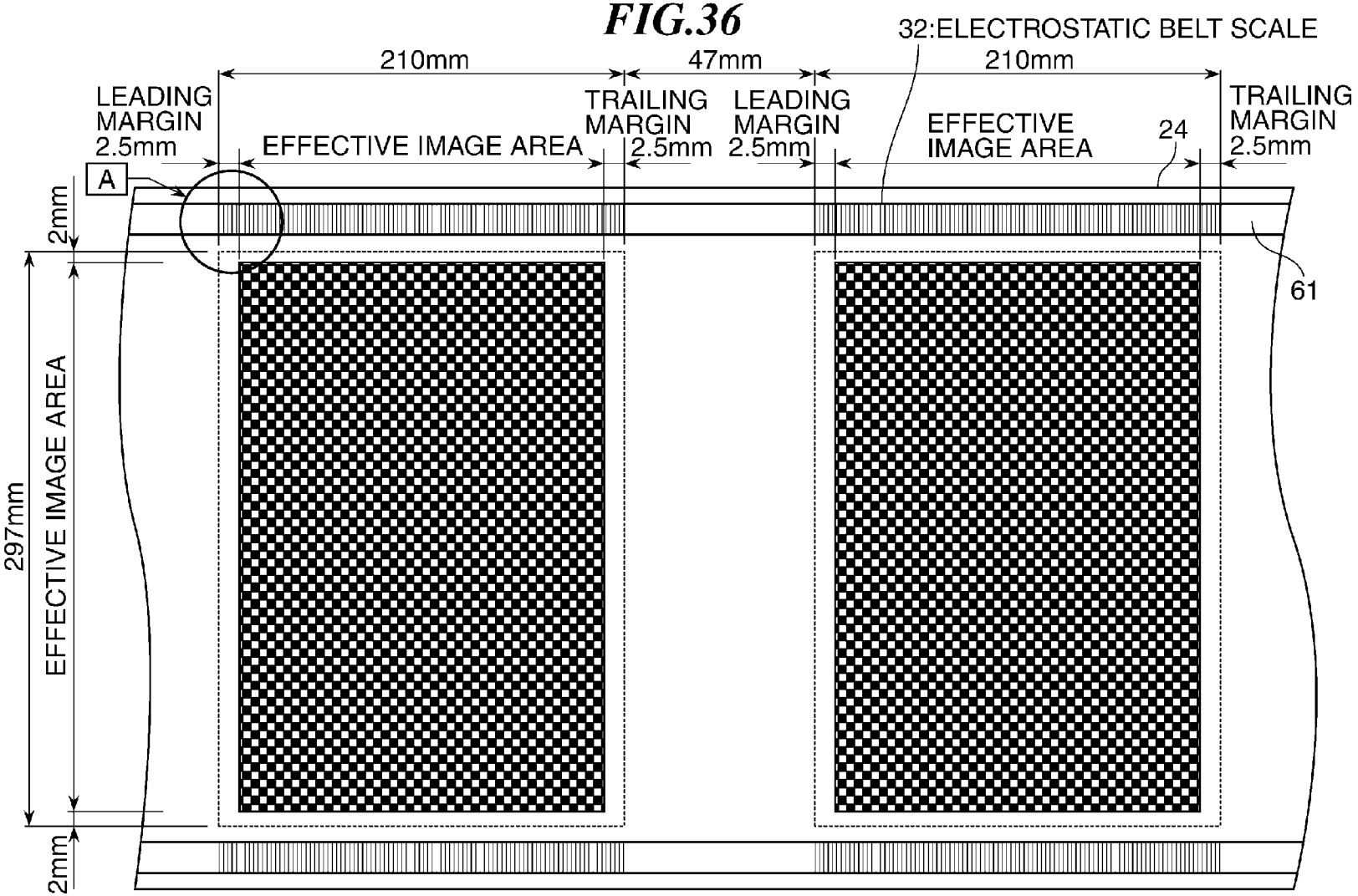
FIG. 36 is a view useful in explaining the positional relationship between a toner image transferred onto an intermediate transfer belt in a first image forming unit and an electrostatic belt scale transferred onto a transfer section.
Figure 37:
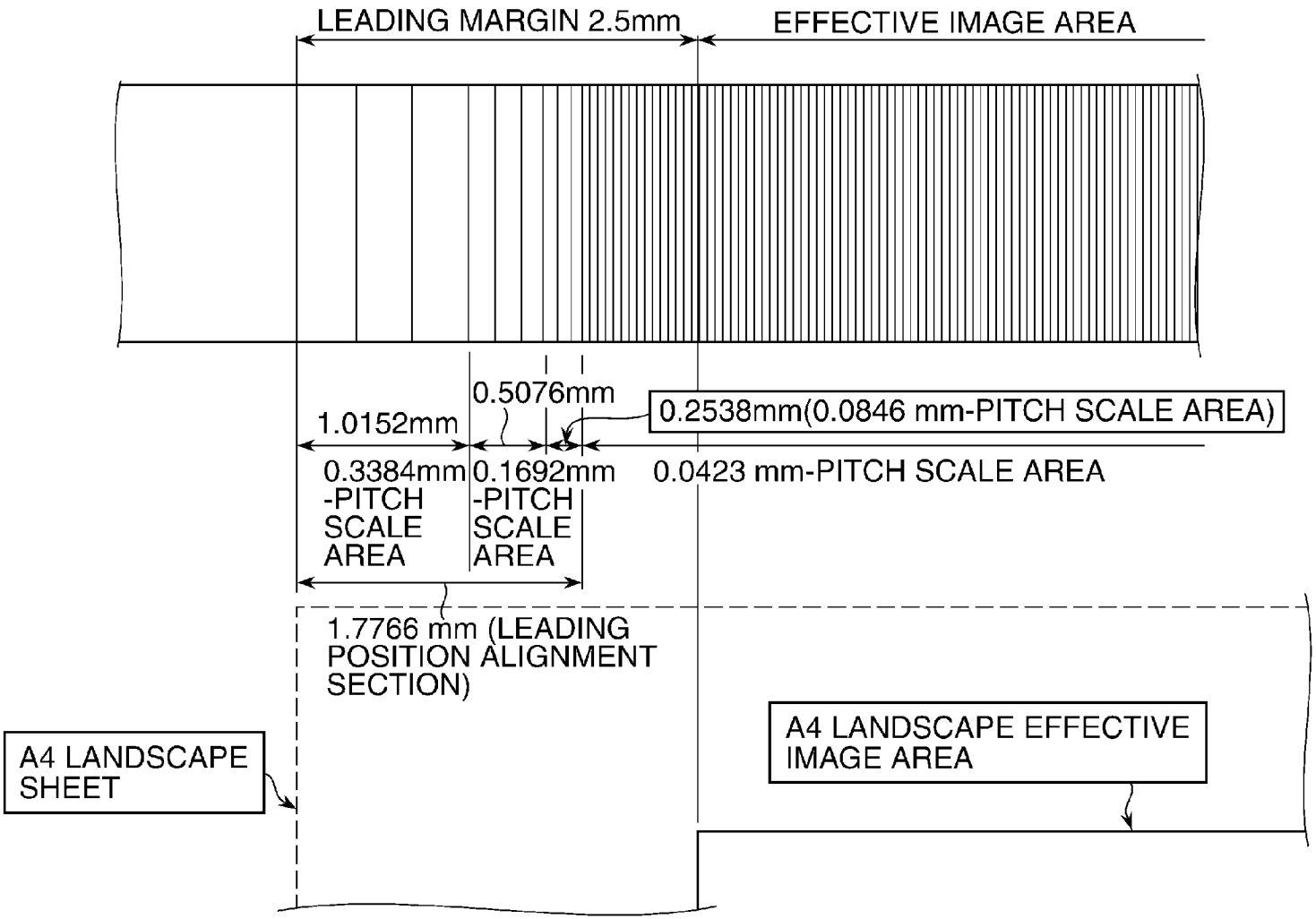
FIG. 37 is a partial enlarged view of a part A in FIG. 36.

FIG. 36 is a view useful in explaining the positional relationship between a toner image transferred on the intermediate transfer belt 24 by the first image forming unit 43*a*, which is to be transferred onto a recording medium of A4 landscape size, and the electrostatic belt scale 32 transferred onto the transfer section 61, and the arrangement of these. FIG. 37 is a partial enlarged view useful in explaining a portion of the electrostatic belt scale 32 corresponding to a leading margin of the toner image, indicated by a portion A appearing in FIG. 36.

FIG. 36 shows a portion of the intermediate transfer belt 24 in a state having two consecutive pages transferred thereto each comprising a toner image of an image to be formed on the recording medium of A4 landscape size and the electrostatic belt scales 32 by the first image forming unit 43*a*. In general, in the case of transferring a toner image from a photosensitive drum to an intermediate transfer belt and further from the intermediate transfer belt to a recording sheet, the transfer operation is performed while causing slip between the photosensitive drum, the intermediate transfer belt, and the recording sheet by making a speed difference of 0.5% between them. However, in the present embodiment, it is assumed, for convenience of description, that the amount of slippage in a conveying direction is equal to zero, and a toner image identical in size to a toner image transferred on a recording sheet is formed on each photosensitive drum and the intermediate transfer belt.

The surface of the recording sheet of A4 landscape size cannot be fully used for image formation, but an image is formed with margins secured along the respective front, rear, left, and right sides of the recording sheet. In the present embodiment, the front and rear margins are set to 2.5 mm and the left and right margins to 2 mm, as shown in FIG. 36. In the case of forming an image for one page on the photosensitive drum 1*a* of the first image forming unit 43*a*, an exposure operation is started on a portion corresponding to the leading end of a recording sheet, and formation of the electrostatic latent image scale lines 31*a* is started on the opposite ends of the photosensitive drum 1*a* at locations 2.5 mm ahead of an area where the toner image is to be formed.

In the present embodiment, it is assumed that the image forming apparatus has an image resolution of 1200 dpi and the laser beam is irradiated for exposure at a pitch of 0.02115 mm, which is calculated by 25.4 (mm)/1200=0.02116666 . . . (mm). To form the electrostatic latent image scale lines 31*a*, when scale lines are formed at a pitch of 1 line/1 space, i.e. by repeating exposure/non-exposure every other line, the pitch of scale lines becomes minimum. In the present embodiment, the minimum scale line pitch is calculated as 0.02115×2=0.0423 mm. Therefore, the electrostatic latent image scale lines 31*a* in the toner image forming area are formed at a pitch of 0.0423 mm, i.e. with the minimum pitch which enables one-line/one-space formation.

Further, in the present embodiment, an exposure operation is performed such that scale lines are formed at a larger pitch in the leading marginal portion for one-page image formation than in the effective image area, so as to enable reliable alignment of leading marks in the second and following image forming units. FIG. 37 is an enlarged view of the portion A in FIG. 36, and shows the arrangement of an electrostatic latent image scale portion formed in a portion corresponding to a front marginal portion forward of the image. Referring to FIG. 37, first, scale lines are formed in a portion corresponding to the leading portion of the margin. Specifically, four scale lines are formed at a pitch of 0.3384 mm eight times larger than the scale line pitch of 0.0423 mm in the effective image area. Then, three scale lines are formed at a pitch of 0.1692 mm half as large as the pitch of 0.3384 mm. Further, three scale lines are formed at a pitch of 0.08846 mm half as large as the pitch of 0.1692 mm. Thereafter, scale lines are formed at the pitch of 0.0423 mm i.e. at the same pitch as that in the effective image area, such that an electrostatic latent image scale portion is formed as far as the rear marginal area.

As shown in FIG. 37, the length of an area having the scale lines formed at the larger pitches than in the effect image area can be calculated as 0.3384×3+0.1692×3+00846×3=1.0152+0.5076+0.2538=1.7766 mm. In short, the area is shorter than the leading margin. In the second image forming unit 43*b* and the following image forming units as well, formation of scale lines in the leading marginal portion is started at the scale line pitch eight times larger than that in the effective image area, and then the scale line pitch is progressively reduced to the pitch four times larger than that in the effective image area, to the pitch twice larger, and finally to the minimum pitch. Conventionally, in the electrophotographic apparatus, it is expected that an image shift occurs by approximately 100 to 150 μm. Therefore, the position of an electrostatic latent image scale transferred on the photosensitive drum 1*b* at the transfer position by the second image forming unit 43*b* shifts with respect to the electrostatic belt scale 32 transferred to the intermediate transfer belt 24 by the first image forming unit by approximately 150 μm at the maximum. Accordingly, after detection of an electrostatic latent image scale line on one of the drum and the belt, an electrostatic latent image scale line on the other is detected unexceptionally. In short, corresponding scale lines are detected alternately. Therefore, it is only required to adjust the rotational speed of the photosensitive drum whenever a drum-side electrostatic latent image scale line is detected, such that the drum-side electrostatic latent image scale is aligned with the electrostatic belt scale 32. In the present embodiment, since the scale line pitch in the leading marginal portion is progressively reduced, it is possible to continuously perform the alignment without missing corresponding scale lines, until the effective image area is reached.

Figure 38:
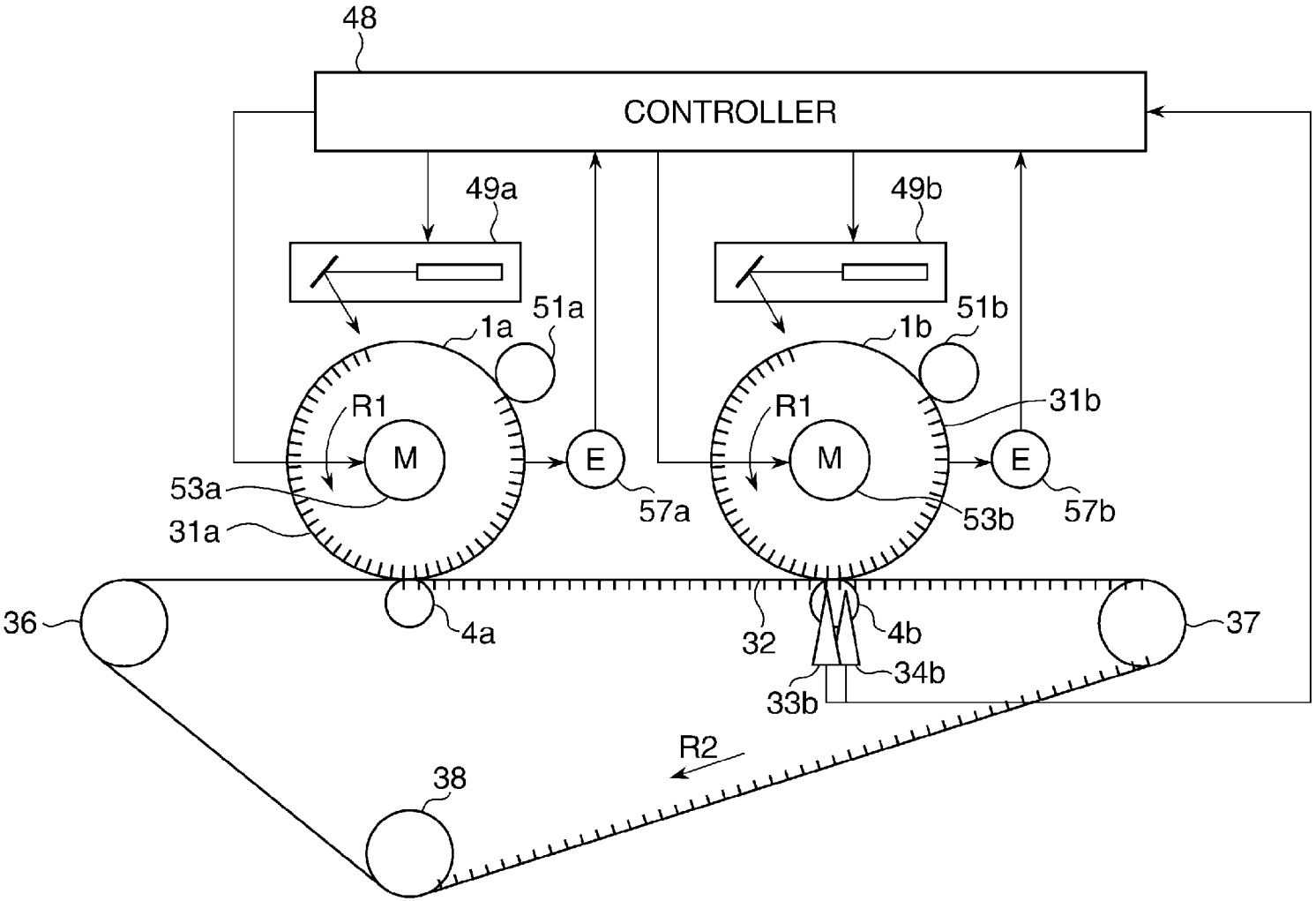
FIG. 38 is a control block diagram useful in explaining control of color shift in the sub scanning direction in the image forming apparatus of the present invention.
Figure 39A:
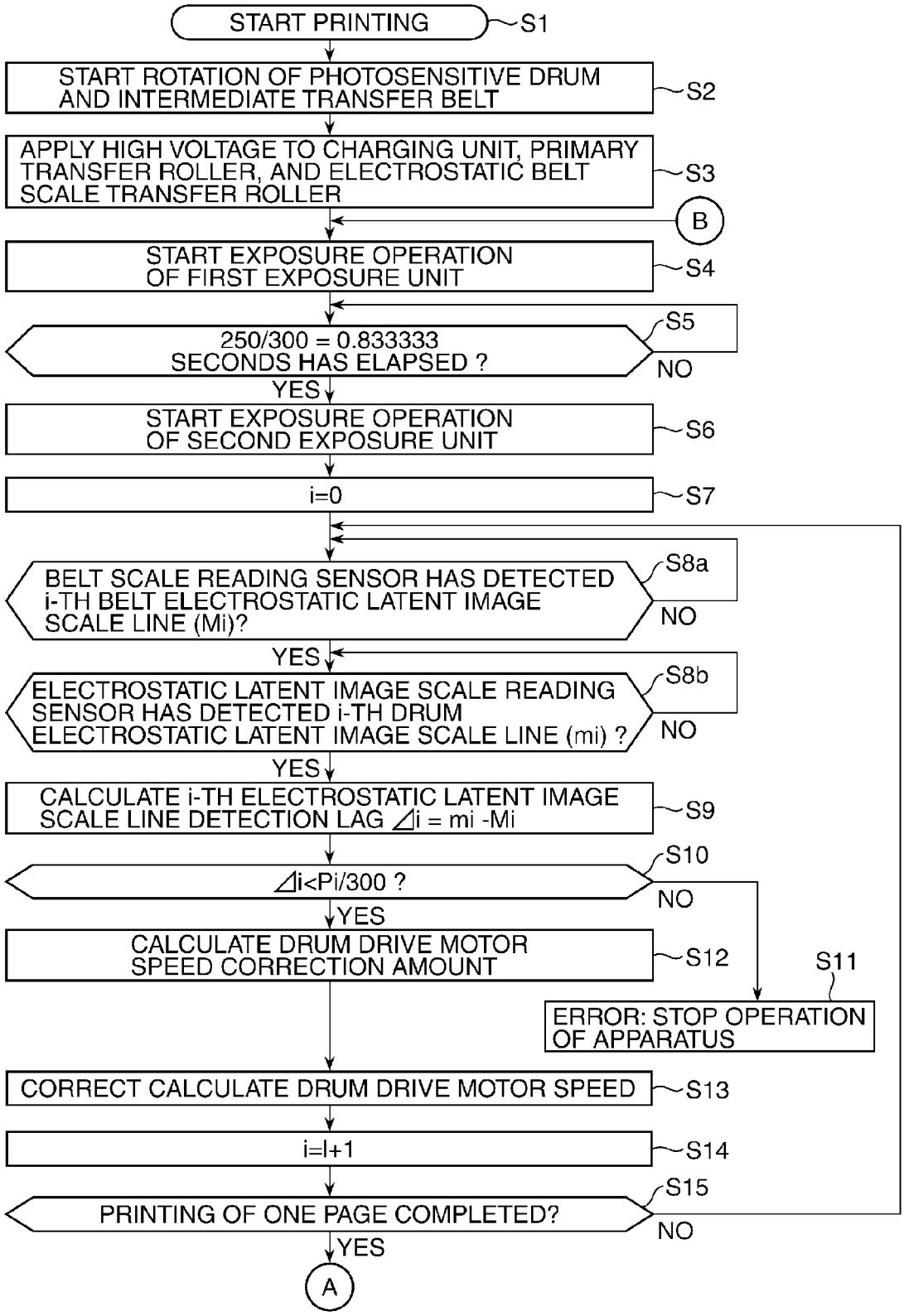
FIGS. 39A and 39B are a flowchart of a color shift control process executed by a controller appearing in FIG. 38, using a sub-scan color shift correction method.
Figure 39B:
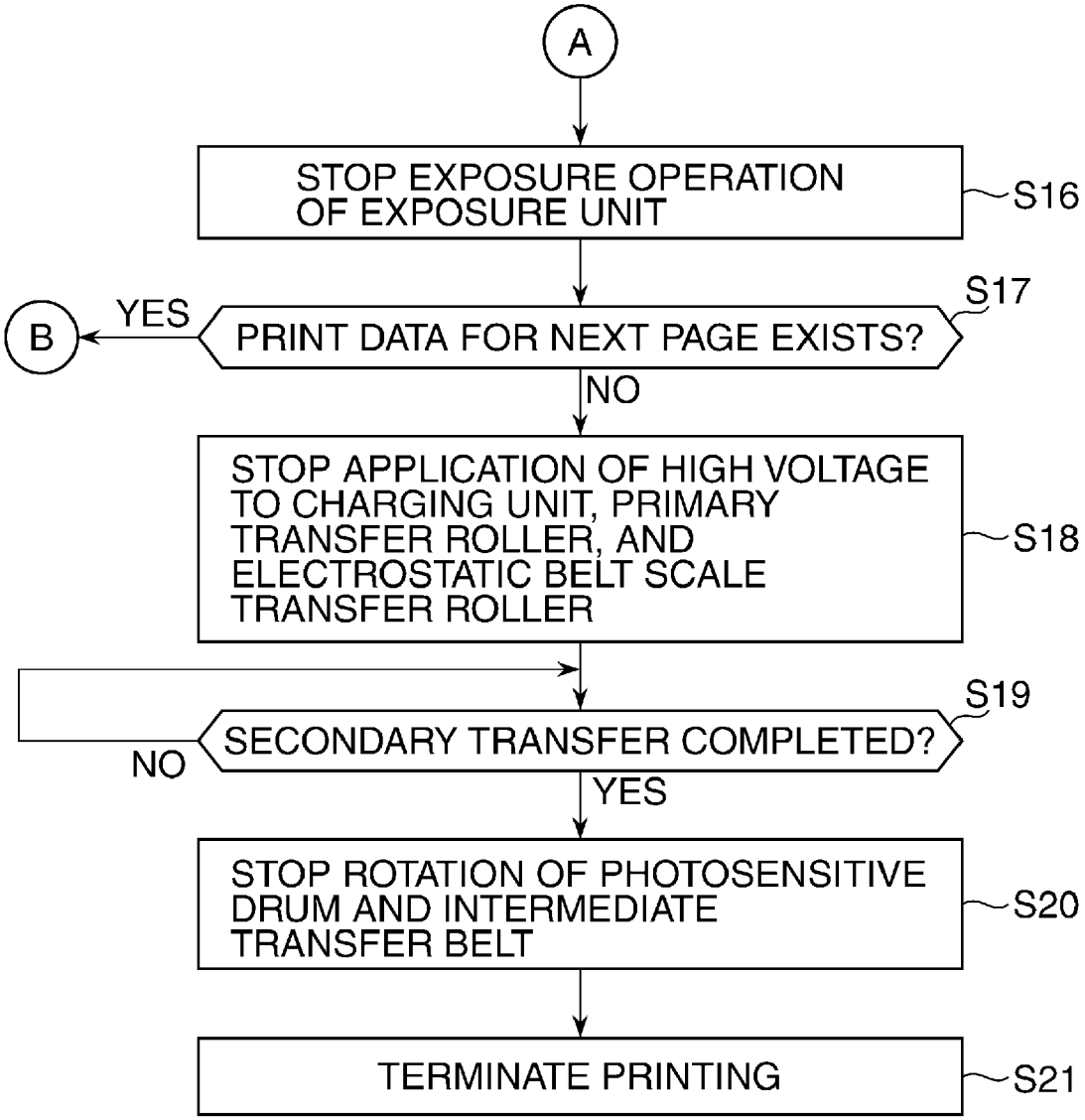

FIG. 38 is a control block diagram useful in explaining control of color shift in the sub scanning direction in the electrophotographic apparatus of the present invention, and FIGS. 39A and 39B are a flowchart of a color shift control process executed by a controller 48 appearing in FIG. 38, using a sub-scan color shift correction method. FIG. 38 shows only the second image forming unit because the following image forming units are identical in construction to the second image forming unit. In the following, the image formation and the image alignment in the present embodiment will be described through description of the color shift control process shown in FIGS. 39A and 39B.

Upon reception of a print start signal in a step S1, the controller 48 gives a rotation start instruction to the drum drive motors 53*a* and 53*b* and a belt drive motor, not shown, and controls the drum drive motors 53*a* and 53*b* to perform uniform rotation, while reading signals respectively from the drum encoder 57*a* and a drum encoder 57*b* directly connected to drum drive shafts of the respective photosensitive drums 1*a* and 1*b*, to thereby cause the photosensitive drums 1*a* and 1*b* to perform uniform rotation in a direction indicated by an arrow R1 in FIG. 38. Similarly, the controller 48 drivingly controls the belt drive motor, not shown, according to a signal from a belt driving roller encoder, not shown, mounted on a belt drive roller shaft, not shown, to perform uniform rotation to thereby cause the intermediate transfer belt 24 wound around the belt driving roller 36 to rotate in a direction indicated by an arrow R2 in FIG. 38, at a constant speed (step S2). Then, in a step S3, application of a predetermined high voltage to the charging unit 51*a* and a charging unit 51*b*, the primary transfer rollers 4*a* and 4*b*, and the electrostatic belt scale transfer roller 47 is started, whereby the surfaces of the respective photosensitive drums 1*a* and 1*b* are charged to −600 V in the present embodiment.

Next, in a step S4, if the controller 48 receives an image signal, the first exposure unit 49*a* starts an exposure operation, whereby the electrostatic latent image scale lines 31*a* are formed at the predetermined pitches in the portion corresponding to the leading margin, as described with reference to FIGS. 36 and 37. Then, exposure is started also for image data and the exposure operation is continued until completion of the exposure of one page of image data as well as the exposure of the electrostatic latent image scale lines 31*a*.

Then, it is determined in a step S5 whether or not 0.8333333 seconds have elapsed after the first exposure unit 49*a* started the exposure operation, whereafter a second exposure unit 49*b* starts an exposure operation in a step S6. In the present embodiment, the diameter of each photosensitive drum is set to 84 mm, the pitch (station-to-station pitch) between the first image forming unit 43*a* and the second image forming unit 43*b* to 250 mm, exposure-to-transfer distance from an exposure position on a photosensitive drum surface to a position for transferring a toner image onto the intermediate transfer belt to 125 mm, and belt conveying speed and circumferential speed of the photosensitive drum to 300 mm/s. Insofar as timing for writing an electrostatic latent image on a photosensitive drum 1 is concerned, control is performed such that the writing on the photosensitive drum 1 is delayed by time required for conveyance of the intermediate transfer belt 24 from a position for transfer of a toner image from a photosensitive drum 1 of an upstream image forming unit onto the intermediate transfer belt 24 to a position for transfer of a toner image from a photosensitive drum 1 of a next image forming unit onto the intermediate transfer belt 24. Therefore, a time interval from the start of an image forming operation by the first image forming unit 43*a* to the start of an image forming operation by the second image forming unit 43*b* is calculated as 250 (mm)÷300 (mm/s)= 0.8333333 (s).

Next, i is set to 0 (i=0) in a step S7. In a case where the rotational speed of each of the photosensitive drums 1*a* and 1*b* does not change and the intermediate transfer belt 24 is conveyed between the transfer positions at a constant speed, no image shift occurs between toner images transferred onto the intermediate transfer belt 24 in superimposed relation. When speed irregularity occurs in the intermediate transfer belt e.g. due to eccentricity of the belt driving roller or uneven thickness of the intermediate transfer belt or when speed change occurs in the drum drive motor or a belt drive roller drive motor, an image shift occurs. However, the speed irregularity due to eccentricity of the belt driving roller or uneven thickness of the intermediate transfer belt can be corrected by measuring the eccentricity of the belt driving roller or the uneven thickness of the intermediate transfer belt in advance. Further, speed change in the drum drive motor or the belt drive roller drive motor can be corrected using an encoder mounted on the shaft of the associated motor. However, expansion/contraction of the intermediate transfer belt 24, which is caused by tension variation in the intermediate transfer belt 24 between the image forming units due to differences in amount between toners transferred in the respective image forming units, not only differs depending on an image, but also changes depending on the amount of transferred toner or the value of a first transfer voltage or the like, which is determined according to a processing condition, and hence it is unpredictable and extremely difficult to correct. This tension variation causes a change in time taken for a toner image transferred onto the intermediate transfer belt 24 in an upstream image forming unit to reach the associated downstream image forming unit. As a consequence, color shift corresponding to the time change occurs. In the present embodiment, even when an unpredictable speed change occurs in the intermediate transfer belt 24, color shift is prevented by controlling the rotation of the drum drive motor 53 connected to the photosensitive drum 1, such that the electrostatic latent image scale lines 31*b* coincide with the associated electrostatic belt scale 32 at the transfer position.

Next, it is determined in steps S8*a* and S8*b* whether an i-th (i=0) electrostatic latent image line has been detected by one of the belt scale reading sensor 33*b* and the electrostatic latent image scale reading sensor 34*b* earlier than by the other, and the other sensor detects the electrostatic latent image line at least before the one sensor detects the following electrostatic latent image line. In a step S9, a time difference Δi between detection of the leading electrostatic latent image scale line on the drum and detection of the corresponding one on the belt is calculated, and then in a step S10, the time difference Δi and a value obtained by dividing a scale line pitch Pi by a conveying speed 300 mm/s are compared with each other. If the time difference Δi is smaller than the value of Pi/300, it means that before the one sensor detects another second electrostatic latent image scale line, the other sensor has detected the corresponding electrostatic latent image scale line, and therefore which scale lines on one of the drum and the belt are required to be associated with which scale lines on the other of the drum and the belt is clearly determined. On the other hand, if the time difference Δi is larger than the value of Pi/300, which means that the other sensor could not detect the first electrostatic latent image scale line before the one sensor detects the second electrostatic latent image scale line, it is impossible to determine which scale lines on the one of the drum and the belt are required to be associated with which scale lines on the other of the drum and the belt. In the present embodiment, the scale line pitch Pi in the portion corresponding to the front marginal area forward of the image is set to 0.3384 mm, which is eight times larger than that in the effective image area, so as to increase the pitch of electrostatic latent image scale lines to be formed, as described in FIGS. 36 and 37, such that normally, the leading electrostatic latent image scale lines can be alternately detected. However, when some abnormality occurs and load acting on the intermediate transfer belt increases, causing a large slippage between the belt drive roller and the intermediate transfer belt, the leading electrostatic latent image scale lines on the respective drum and belt cannot be alternately detected. In such a case, it is determined in a step S11 that an error has occurred, and the operation of the apparatus is stopped.

Next, in a step S12, the correction amount of the rotational speed of the drum drive motor 53*b* of the second image forming unit 43*b* is calculated based on the time difference Δi obtained in the step S9 such that the deviation between the electrostatic latent image scale on the photosensitive drum and that on the intermediate transfer belt is corrected. Then, in a step S13, the rotational speed of the drum drive motor 53*b* is corrected such that the deviation between the two scales is reduced. Further, the scale line pitch is caused to converge to the minimum pitch before the effective image area is reached. The correction control operation is repeatedly carried out until completion of printing of one page of image data (step S15), and when the printing of the one page of image data is completed, the exposure operation is stopped (step S16).

If print data for a next page exists (step S17), the process returns to the step S4, and image forming operation is continued while performing image alignment by repeatedly carrying out the above-described steps. When no more print data exists, application of high voltage to the charging unit, a primary transfer roller high-voltage unit, a high-voltage unit for electrostatic latent image scale transfer, and so forth is stopped (step S18), but rotation of the photosensitive drum and the primary transfer roller is continued until secondary transfer of the image data onto a recording sheet is completed (step S19). Then, when it is determined that the secondary transfer of all the image data is completed, the drive motors for the photosensitive drum and the intermediate transfer belt are all stopped (step S20), followed by terminating the print operation (step S21).

Next, a description will be given of a main-scan color shift detection method executed so as to control color shift in the main scanning direction.

Figure 1A:
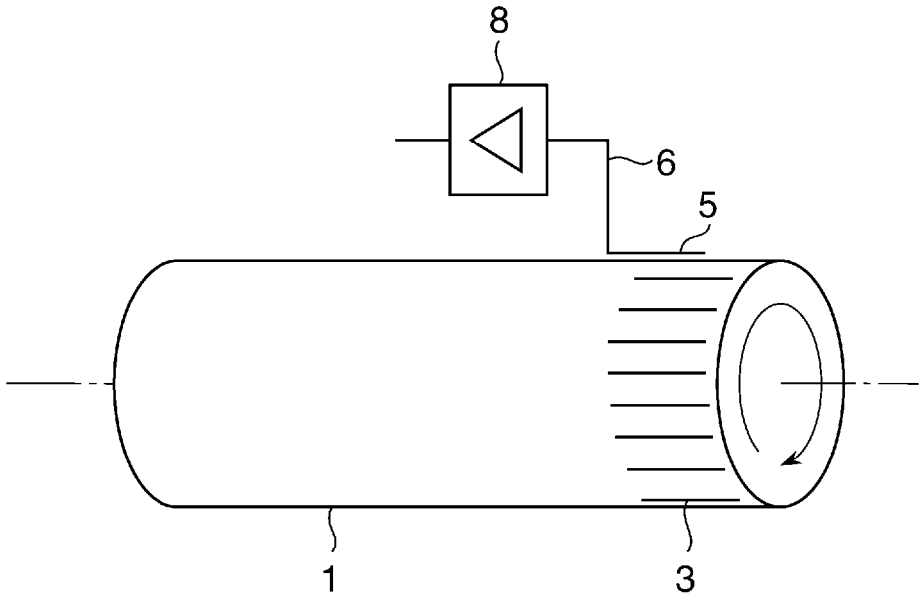
FIGS. 1A and 1B are views showing the positional relationship between electrostatic latent image lines, a conductor, and an image carrier in an image forming apparatus according to a first embodiment of the present invention.
Figure 1B:
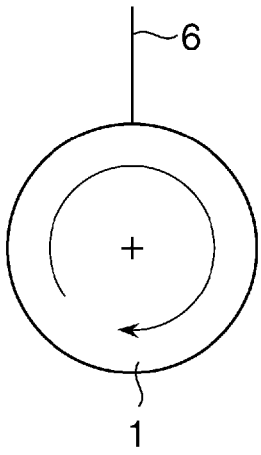

FIGS. 1A and 1B are views showing the positional relationship between electrostatic latent image lines, a conductor, and an image carrier in the image forming apparatus according to the first embodiment of the present invention. FIG. 1A is a front perspective view, and FIG. 1B a side view. The electrostatic latent image scale lines 31 described hereinabove correspond to electrostatic latent image lines 3 described hereinbelow, and the aforementioned electrostatic latent image scale reading sensor 34 corresponds to a conductor 5 described hereinbelow.

The photosensitive drum 1 as the image carrier is exposed to a laser beam and scanned by the same, whereby a plurality of electrostatic latent image lines 3 are drawn on the photosensitive drum 1. The electrostatic latent image lines 3 are formed at predetermined intervals in parallel with the axis of the photosensitive drum 1.

The conductor 5 is disposed in parallel relation to the electrostatic latent image lines 3 such that when the conductor 5 moves relative to the electrostatic latent image lines 3, it partially overlaps the electrostatic latent image lines 3 one after another.

During the relative motion, induced current is generated in the conductor 5 according to the potential of each electrostatic latent image line 3 opposed thereto. By analyzing the induced current and obtaining the magnitude of change in the potential, it is possible to detect the direction and magnitude of a shift in the main scanning direction.

As shown in FIG. 1A, the conductor 5 is configured to read the potential of each opposed electrostatic latent image line 3 by overlapping the same, and is connected to a conductive wire 6 and a circuit element 8. The circuit element 8 as a detection unit analyzes the induced current and detects the direction and magnitude of a shift in the main scanning direction based on the magnitude of a potential change.

The principle of detection by the conductor 5 and the basic construction of the conductor 5 are described in detail in Japanese Patent Laid-Open Publication No. H11-183542. Further, the conductor 5 is characterized by being covered with polyimide flexible film, not shown, having a thickness of several to several tens of μm so as to prevent discharge due to direct contact with a charged body.

The positional relationship between the conductor 5 and each electrostatic latent image line 3 will be described in detail with reference to FIGS. 2A to 2C.

Figure 2A:
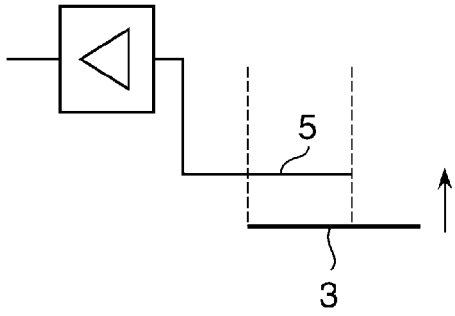
FIGS. 2A to 2C are views each showing the positional relationship between an electrostatic latent image line and the conductor in the first embodiment.

FIG. 2A illustrates a case where the electrostatic latent image line 3 is not shifted in the main scanning direction. FIG. 2B illustrates a case where the electrostatic latent image line 3 is shifted leftward, and FIG. 2C illustrates a case where the electrostatic latent image line 3 is shifted rightward.

Figure 3A:
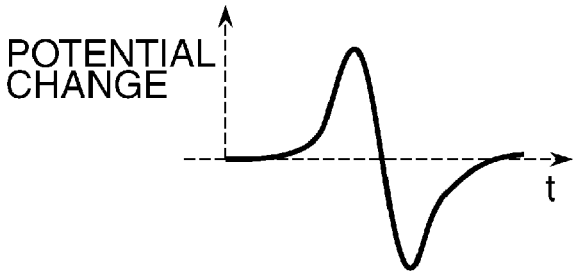
FIGS. 3A to 3C are diagrams showing potential changes in the first embodiment.

If the conductor 5 is disposed such that during relative motion between the conductor 5 and the electrostatic latent image lines 3, the conductor 5 partially overlaps each of the electrostatic latent image lines 3 as shown in FIG. 2A, the potential detected by the conductor 5 during passage of an electrostatic latent image line 3 changes as shown in FIG. 3A.

Figure 3B:
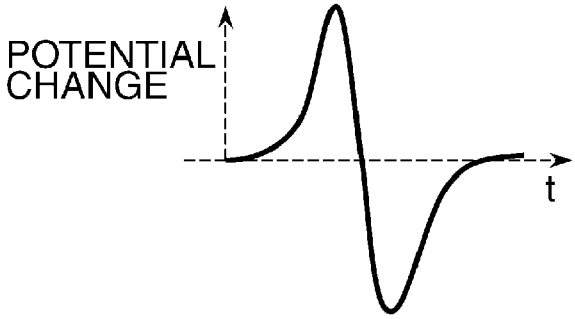
Figure 3C:
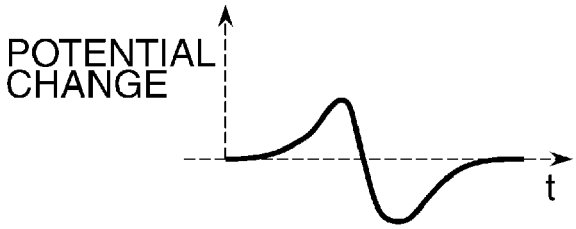

In each of FIGS. 3A to 3C, the vertical axis represents potential change, and the horizontal axis represents time. When an electrostatic latent image line 3 starts overlapping the conductor 5, a potential change rise occurs, and when the conductor 5 starts moving away from the electrostatic latent image line 3, a potential change drop occurs.

Figure 2B:
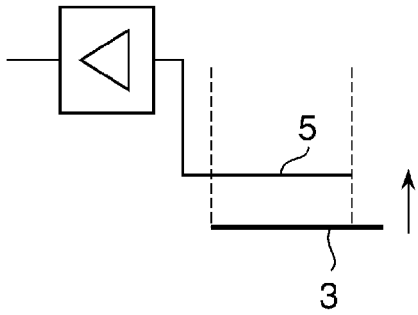

On the other hand, in the case shown in FIG. 2B, since the electrostatic latent image line 3 is shifted leftward, the length of overlap between the electrostatic latent image line 3 and the conductor 5 during the relative motion becomes larger, and hence the value of the potential change also becomes larger, compared with when there is no shift in the main-scan direction (see FIG. 3B).

Figure 2C:
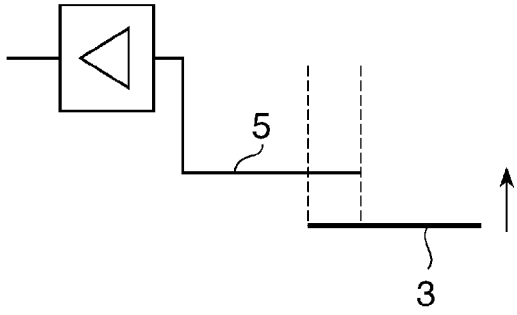

Further, in the case shown in FIG. 2C, since the electrostatic latent image line 3 is shifted rightward, the length of overlap between the electrostatic latent image line 3 and the conductor 5 during the relative motion becomes smaller, and hence the value of the potential change also becomes smaller (see FIG. 3C). The use of this method makes it possible to grasp the direction and magnitude of image shift in the main scanning direction. A position shift amount in the main scanning direction can be calculated based on the amplitude of the potential change obtained in each of FIGS. 3A to 3C.

The amount of image shift in the sub scanning direction can be grasped based on intervals at which an output signal is output from the electrostatic latent image lines 3 circumferentially formed on the photosensitive drum 1 in parallel relation to the axis thereof, as described hereinbefore.

In short, the circuit element 8 as the detection unit can detect image shifts in both the main scanning direction and the sub scanning direction based on a result of measurement of the induced current generated by the conductor 5.

Figure 4A:
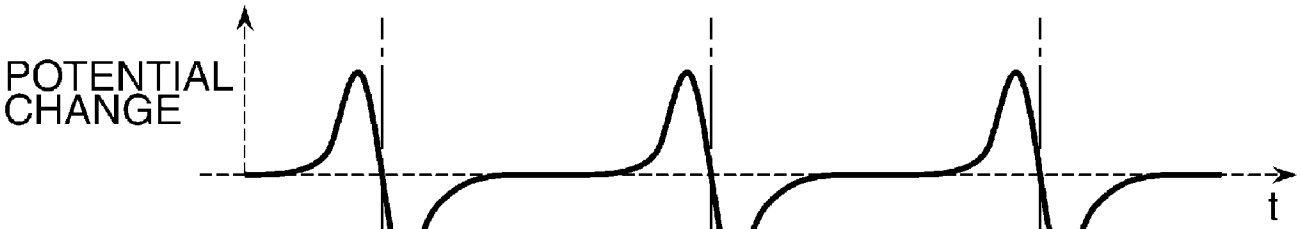
FIGS. 4A and 4B are diagrams each showing a detected image shift in a sub scanning direction.
Figure 4B:
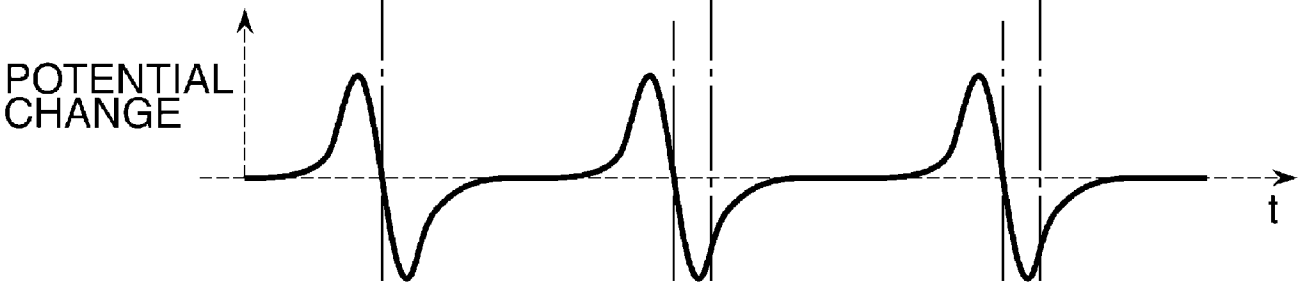

FIGS. 4A and 4B are diagrams illustrating potential change that occurs during passage of the conductor 5 across a plurality of electrostatic latent image lines 3. The vertical axis represents potential change, and the horizontal axis represents time, similarly to FIGS. 3A to 3C.

FIG. 4A shows a case where no position shift has occurred in the sub scanning direction. FIG. 4B shows that a second electrostatic latent image line 3 was detected earlier than in the case shown in FIG. 4A, and therefore it can be understood that the second electrostatic latent image line 3 is shifted in the sub scanning direction. Detection of a position shift in the sub scanning direction is performed as described above.

In the above example described with reference to FIGS. 1A and 1B to FIGS. 3A to 3C, a position shift in the main scanning direction is detected by detecting an electrostatic latent image line 3 on a drum, and this method can also be applied to the belt scale reading sensor 33 appearing in FIGS. 30 and 31.

Figure 40B:
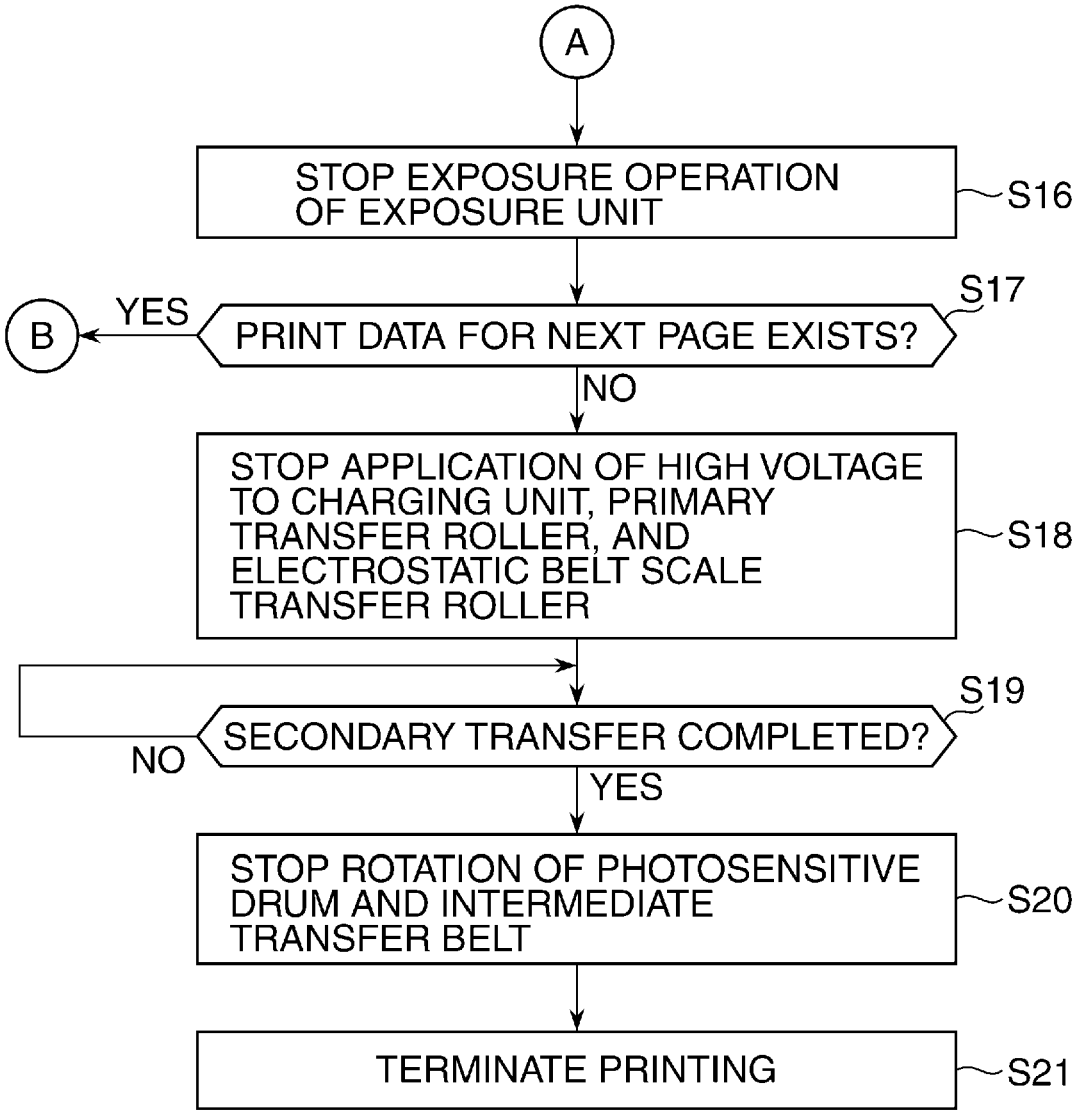

FIGS. 40A and 40B show a color shift control process using not only the sub-scan color shift correction method in FIGS. 39A and 39B, but also the main-scan color shift correction method. Only the color shift correction in the sub scanning direction is described hereinbefore for simplicity of explanation, but in an actual apparatus, the color shift control process in FIGS. 40A and 40B is executed so as to perform main-scan color shift correction and sub-scan color shift correction at the same time. Steps S1 to S10 are the same as the corresponding steps executed as the sub-scan color shift correction method in FIGS. 39A and 39B. If it is determined that $\Delta i<Pi/300$, in parallel with the steps S12 and S13, steps S22 to S24 are executed. More specifically, first, the position shift in the main scanning direction between the i-th belt electrostatic latent image line and the i-th electrostatic latent image scale line 31 is calculated by the CPU (step S22).

Then, the shift amount of the drum in the main scanning direction is calculated (step S23).

Then, in the step S24, the entire image forming unit 43*b* is moved along the axial direction of the photosensitive drum 1*b* according to the calculated shift amount, using a piezo element, not shown, as described in Japanese Patent Laid-Open Publication No. 2009-116250. As a consequence, the exposure position for exposing the photosensitive drum 1*b* is also moved, which makes it possible to correct color shift in the main scanning direction.

Figure 41:
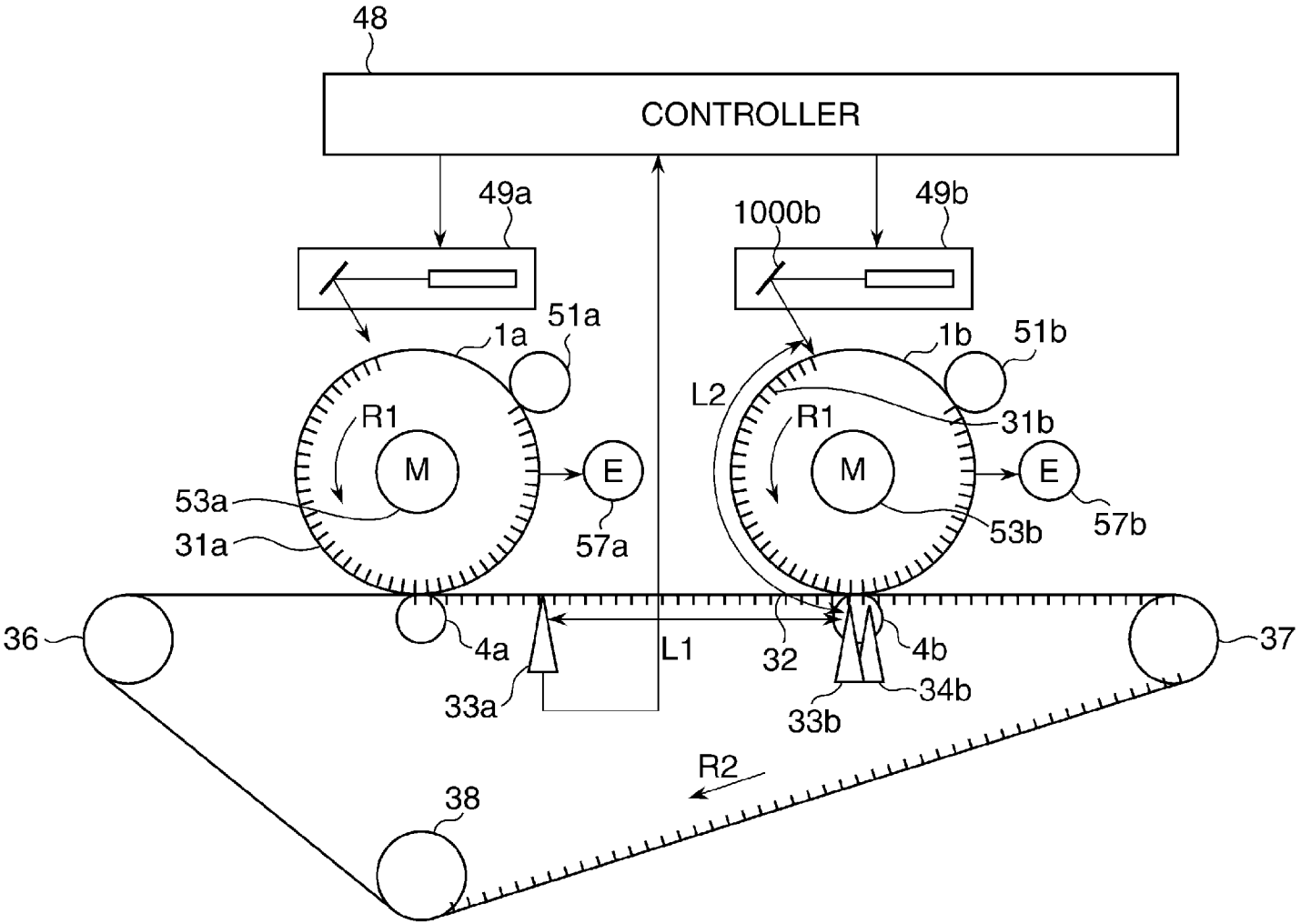
FIG. 41 is a control block diagram useful in explaining control of color shift in the main scanning direction in the image forming apparatus of the present invention.

The method of correcting color shift in the main scanning direction on a real-time basis can be executed not only by using the piezo element to move the image forming unit 43*b* along the axial direction of the photosensitive drum 1*b*. FIG. 41 shows only an arrangement for control of correction of color shift in the main scanning direction on a real-time basis. Specifically, assuming that a distance from an exposure position of the photosensitive drum 1*b* to a transfer position of the same is represented by L2, a belt scale reading sensor 33*a* is disposed at a location upstream of the transfer position of the photosensitive drum 1*b* such that a length relationship of L2<L1 holds. A position change in the main scanning direction of the electrostatic belt scale 32 transferred as an electrostatic latent image from the photosensitive drum 1*a* is estimated from the amplitude of the output voltage, examples of which are illustrated in FIGS. 3A, 38, and 3C, by the belt scale reading sensor 33*a* disposed a distance L1 away from the transfer position of the photosensitive drum 1*b*. Electrostatic belt scale lines to be sequentially formed on the photosensitive drum 1*b* and hence to be sequentially detected after the start of image formation are associated with respective addresses in a memory of the controller. This makes it possible to determine in which position in a sequence of scale lines formed after the start of image formation each detected electrostatic belt scale line is. Therefore, it is possible to feed back an amount of position change in the main scanning direction detected by the belt scale reading sensor 33*a* to exposure executed on the photosensitive drum 1*b*. The feedback of the amount of position change in the main scanning direction to exposure executed on the photosensitive drum 1*b* is performed by modulating a frequency for determining timing for writing by an exposure beam irradiated on a rotary polygon mirror 1000*b* of the exposure unit 49*b* of the photosensitive drum 1*b*. Although FIG. 41 shows only the first image forming unit 43*a* and the second image forming unit 43*b* as the image forming units, for simplicity, the above-described control is performed in the third and fourth image forming units as well to thereby enable real-time correction of color shift in the main scanning direction.

In the above description, the method of correcting color shifts in the main and sub scanning directions on a real-time basis is explained. However, insofar as the method of detecting color shifts in the main and sub scanning directions, which is described hereinabove with reference to FIGS. 1A to 4B, is concerned, it is possible to apply auto registration to the method of correcting color shift that changes in a long time. To put it simply, the electrostatic latent image scale lines 31 are transferred onto the intermediate transfer belt from each of the first to fourth image forming units to thereby form the electrostatic belt scale 32, and the electrostatic latent image scale reading sensor 34 is disposed downstream of the fourth image forming unit. This electrostatic latent image scale reading sensor 34 reads the electrostatic belt scales formed by the respective image forming units to thereby detect amounts of color shift. The frequency for determining timing for writing by an exposure beam irradiated at the rotary polygon mirror in the exposure unit 49 of each of the image forming units is modulated based on an associated one of the detected amounts of color shift, whereby color shifts in the main scanning direction are corrected. Further, color shift in the sub scanning direction is corrected by controlling the rotational speed of the rotary polygon mirror in the exposure unit 49 of each of the image forming units or by controlling the rotational speed of each photosensitive drum.

The method of the first embodiment makes it possible to detect the direction and magnitude of image shift on the photosensitive drum 1 in both the main scanning direction and the sub scanning direction. However, when a position shift in the main scanning direction is very small compared with the length of overlap between an electrostatic latent image line and the conductor, it is difficult to detect the position shift as a potential change value.

Figure 5A:
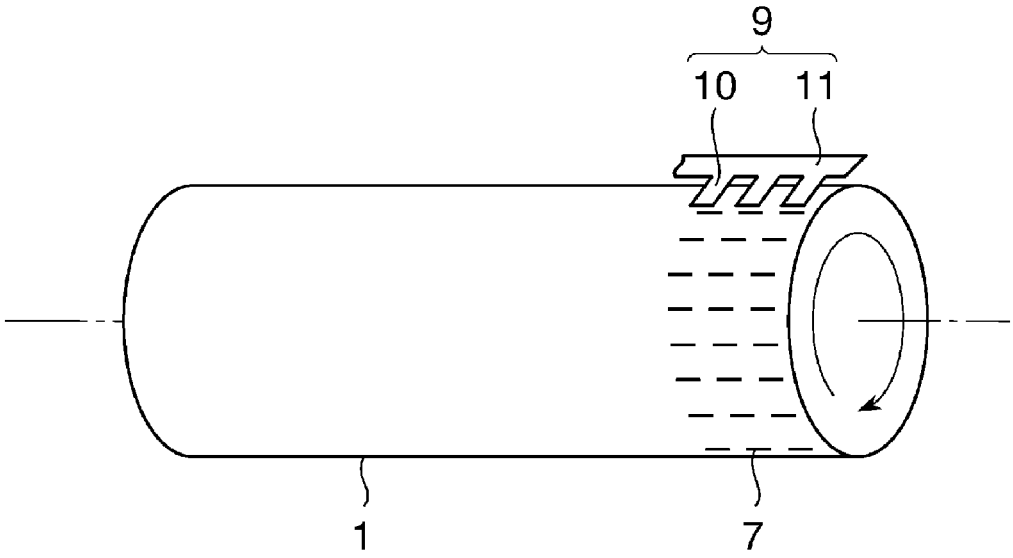
FIGS. 5A and 5B are views showing the positional relationship between electrostatic latent image lines, a conductor, and an image carrier in an image forming apparatus according to a second embodiment of the present invention.
Figure 5B:
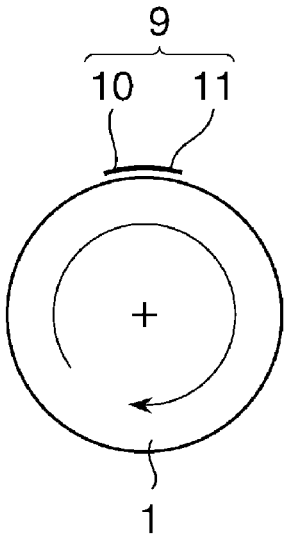

FIGS. 5A and 5B are views showing the positional relationship between an electrostatic latent image line, a conductor, and an image carrier in an image forming apparatus according to a second embodiment of the present invention. FIG. 5A is a front perspective view, and FIG. 5B a side view.

As shown in FIGS. 5A and 5B, the present embodiment is distinguished from the first embodiment by the shape of each electrostatic latent image line 7 and that of a conductor (electrostatic latent image scale reading sensor) 9. In a case where the resolution of the image forming apparatus is set to 600 dpi, each of the electrostatic latent image lines 7 is written as a dotted line formed by dots (each of 42.3 μm) and spaces (each of 42.3 μm). In short, the electrostatic latent image line 7 is formed by a dotted line with a dot pitch approximately corresponding to the resolution of the image forming apparatus.

Further, the conductor 9 has a comb-teeth shape conforming to the dot pitch of the electrostatic latent image line 7. Specifically, the conductor 9 is comprised of comb tooth parts 10 and a comb teeth support portion 11.

The positional relationship between the conductor 9 and the electrostatic latent image line 7 will be described with reference to FIGS. 6A to 6C.

Figure 6A:
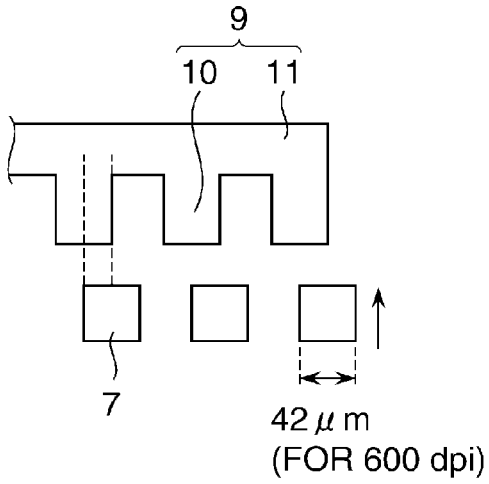
FIG. 6A to 6C are views each showing the positional relationship between an electrostatic latent image line and the conductor in the second embodiment.

FIG. 6A illustrates a case where the electrostatic latent image line 7 is not shifted in the main scanning direction. FIG. 6B illustrates a case where the electrostatic latent image line 7 is shifted leftward, and FIG. 6C illustrates a case where the electrostatic latent image line 7 is shifted rightward.

In the case shown in FIG. 6A, the conductor 9 is disposed such that the comb tooth parts 10 partially overlap the electrostatic latent image line 7 while moving relative to the electrostatic latent image line 7. Potential detected by the conductor 9 during passage of an electrostatic latent image line 7 changes as shown in FIG. 7A.

Figure 7A:
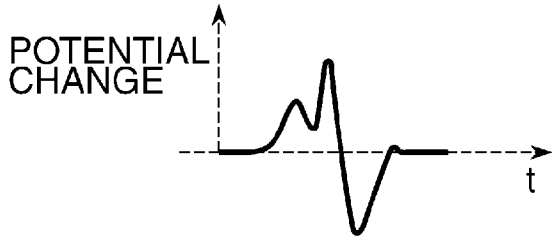
FIGS. 7A to 7C are diagrams showing potential changes in the second embodiment.

As shown in FIG. 7A, an upward potential change having a first crest occurs during passage of the electrostatic latent image line 7 over the comb tooth parts 10, and then an upward potential change having a second crest occurs during passage of the electrostatic latent image line 7 across the comb teeth support portion 11. Further, when the electrostatic latent image line 7 leaves the comb teeth support portion 11, a potential change represented by a wave having a trough occurs.

Now, a description will be given of the potential change shown in FIG. 7A. Assuming that the conductor 9 and the electrostatic latent image line 7 is in the positional relationship shown in FIG. 6A, when the photosensitive drum 1 performs rotation and the electrostatic latent image line 7 on the photosensitive drum 1 starts to partially overlap the comb tooth parts 10 from below, electrons between the conductor 9 and an amplification circuit 8 start to be attracted toward the comb tooth parts 10. When the photosensitive drum 1 further rotates, the number of free electrons attracted toward the comb tooth parts 10 continuously increases until a time point when the electrostatic latent image line 7 and the comb tooth parts 10 completely overlap each other, and then starts to decrease immediately after the time point. When this flow of free electrons is output through the amplification circuit and is plotted on a graph, the upward potential change having the first crest in FIG. 7A can be obtained.

Then, when the photosensitive drum 1 further rotates, the electrostatic latent image line 7 and the comb teeth support portion 11 starts to partially overlap each other, the number of attracted free electrons starts to increase. The number of the attracted free electrons continuously increases until a time point when the electrostatic latent image line 7 and the comb teeth support portion 11 completely overlap each other. Then, immediately after the time point of the complete overlap, as the electrostatic latent image line 7 moves in the sub scanning direction, the number of attracted free electrons decreases, and when and half of the electrostatic latent image line 7 overlaps the comb teeth support portion 11 from below, the value of the output in the FIG. 7A graph becomes equal to 0.

Then, when more than the half of the electrostatic latent image line 7 moves outward of the comb teeth support portion 11, the attracted free electrons start to return, and hence the value of the output in the FIG. 7A graph falls below 0, and when the electrostatic latent image line 7 completely moves away from the comb teeth support portion 11, the value of the output reaches a crest of the downward wave in FIG. 7A.

Figure 6B:
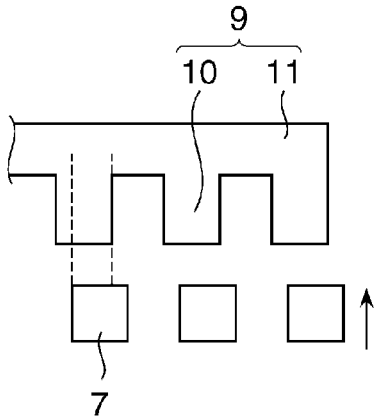
Figure 7B:
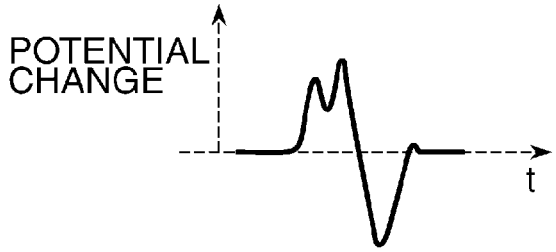

On the other hand, in the case illustrated in FIG. 6B, since the electrostatic latent image line 7 is shifted leftward, the length of overlap between the electrostatic latent image line 7 and the comb tooth parts 10 of the conductor 9 increases, and therefore the upward potential change having the first crest exhibits a larger value than in the case where there is no shift (see FIG. 7B).

Figure 6C:
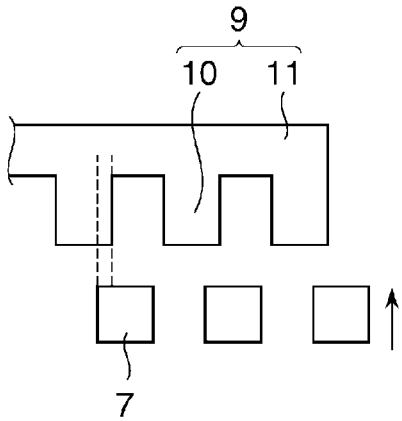
Figure 7C:
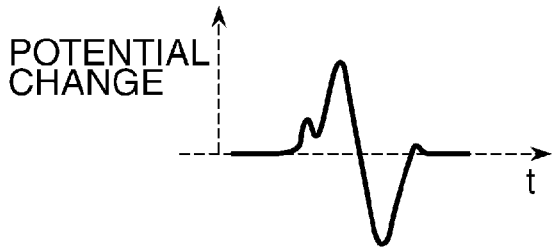

Further, in the case illustrated in FIG. 6C, since the electrostatic latent image line 7 is shifted rightward, the length of overlap between the electrostatic latent image line 7 and the comb tooth parts 10 of the conductor 9 during the relative motion decreases, and therefore the upward potential change having the first crest exhibits a smaller value than in the case where there is no shift (see FIG. 7C).

The use of this method makes it possible to amplify the output signal even when the image shift in the main scanning direction is slight, to thereby make it possible to detect even the slightest position shift with high accuracy. The output signal can be more amplified as the number of dots forming the electrostatic latent image line 7 is larger. It should be noted that the dot pitch of the electrostatic latent image line 7 corresponds to the comb-teeth pitch of the conductor 9.

Further, a position shift in the sub scanning direction can be detected based on an interval of the output signal as in the first embodiment.

Color shifts in the main scanning direction and the sub scanning direction are corrected by the same color shift correction method as that employed in the first embodiment.

The method of the second embodiment makes it possible to detect the direction and magnitude of the slightest image shift in the main or sub scanning direction. However, in the method, determination as to the direction and magnitude of image shift has to be performed based only on different magnitudes of the upward potential change having the first crest, as shown in FIGS. 7A to 7C. Therefore, e.g. if noise is large, it is difficult to properly detect the direction and magnitude of image shift.

Figure 8:
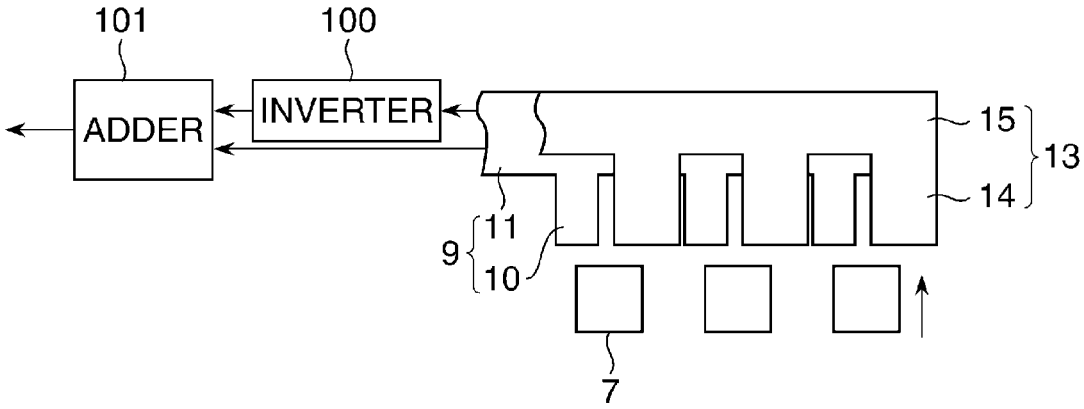
FIG. 8 is a view showing conductors in an image forming apparatus according to a third embodiment of the present invention.
Figure 9:
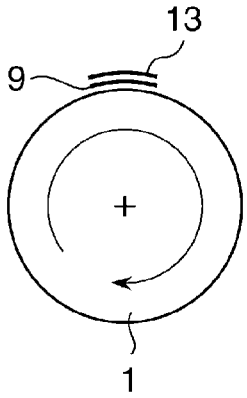
FIG. 9 is a view showing the positional relationship between the conductors and an image carrier in the third embodiment.

FIG. 8 is a view of conductors of an image forming apparatus according to a third embodiment of the present invention. FIG. 9 is a side view of parts of the image forming apparatus, essential for electrostatic latent image scale reading.

In the present embodiment, two kinds of conductors 9 and 13 are provided, as shown in FIG. 8, whereby a circuit is formed in which an output signal obtained from the conductor 13 is inverted by an inverter 100 to be added to an output signal from the conductor 9 by an adder 101. The conductor 13 is comprised of a comb tooth parts 14 and a comb teeth support portion 15.

Figure 10A:
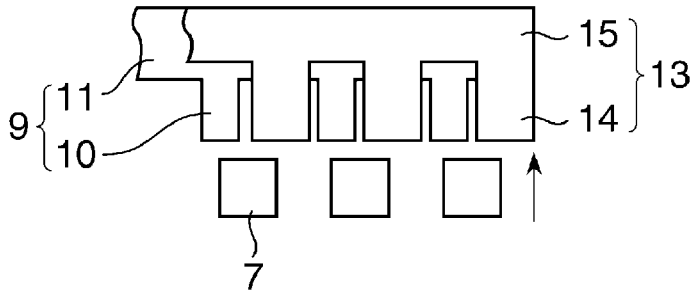
FIGS. 10A to 10C are views each showing the positional relationship between an electrostatic latent image line and the conductors in the third embodiment.
Figure 10B:
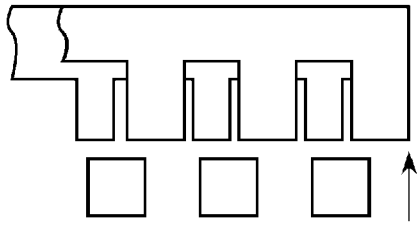
Figure 10C:
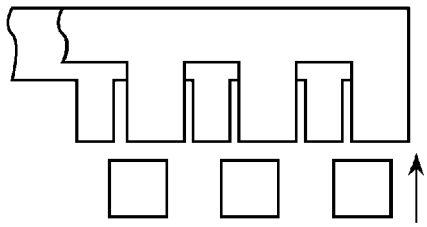

To be more specific, FIGS. 10A to 10C are views showing the positional relationship between the electrostatic latent image line 7 and the conductors 9 and 13, in which FIG. 10A illustrates a case where the electrostatic latent image line 7 is not shifted in the main scanning direction, FIG. 10B illustrates a case where the electrostatic latent image line 7 is shifted leftward, and FIG. 10C illustrates a case where the electrostatic latent image line 7 is shifted rightward.

Figure 11A:
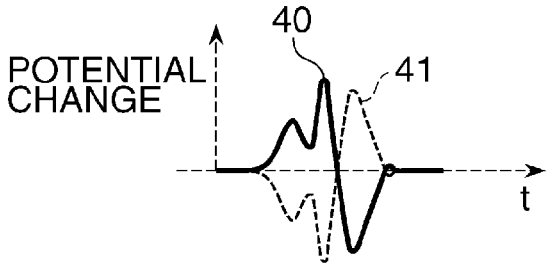
FIGS. 11A to 11C are diagrams showing potential changes in the third embodiment.

The conductors 9 and 13 are disposed such that the comb tooth parts 14 partially overlap the electrostatic latent image line 7 while moving relative to the electrostatic latent image line 7. During passage of an electrostatic latent image line 7 before the conductors 9 and 13, a signal output from the conductor 9 is denoted by 40 in FIG. 11A, and a signal obtained by inverting an output signal from the conductor 13 is denoted by 41 in the same.

Figure 11B:
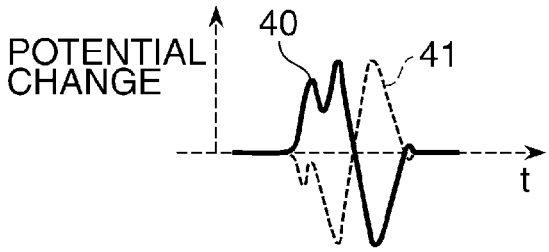
Figure 11C:
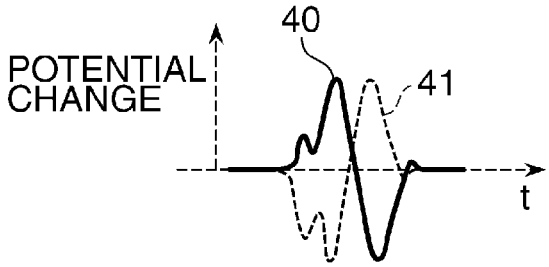
Figure 12A:
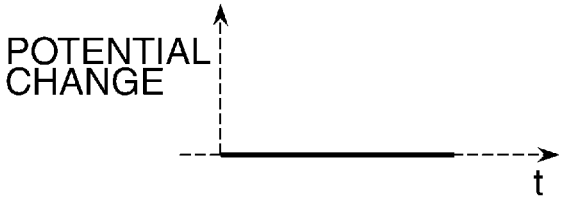
FIGS. 12A to 12C are diagrams showing potential changes obtained by adding outputs from the respective two conductors in the third embodiment.

The vertical axis in each, of FIGS. 11A to 11C and FIGS. 12A to 12C represents potential change, and the horizontal axis represents time. In the case shown in FIG. 10A, when the signal 40 and the signal 41 are added, the value of the signal indicative of potential change becomes equal to 0 as shown in FIG. 12A.

On the other hand, in the case illustrated in FIG. 10B, since the electrostatic latent image line 7 is shifted leftward, the length of overlap between the electrostatic latent image line 7 and the comb tooth parts 10 of the conductor 9 increases, and therefore a potential change having a first crest is larger than in the case where there is no shift (see the signal 40 in FIG. 11B).

Figure 12B:
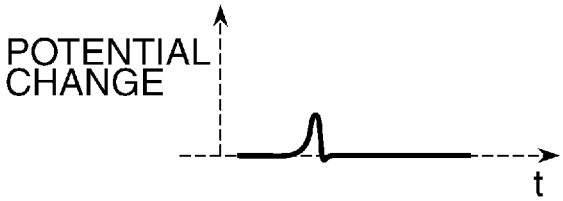

Further, the length of overlap between the electrostatic latent image line 7 and the comb tooth parts 14 of the conductor 13 decreases, and therefore a potential change having a first crest is smaller than in the case where there is no shift (see the signal 41 in FIG. 11B). When the signal 40 and the signal 41 are added, a waveform shown in FIG. 12B is obtained.

Further, in the case illustrated in FIG. 10C, since the electrostatic latent image line 7 is shifted rightward, the length of overlap between the electrostatic latent image line 7 and the conductor 9 during the relative motion decreases, and therefore the potential change having the first crest is smaller than in the case where there is no shift (see the signal 40 in FIG. 11C).

Figure 12C:
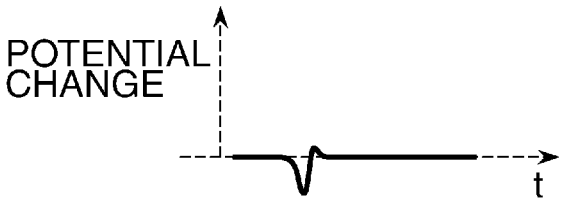

On the other hand, the length of overlap between the electrostatic latent image line 7 and the conductor 13 is increased, and therefore the potential change becomes larger (see the signal 41 in FIG. 11C). When the signal 40 and the signal 41 are added, a waveform shown in FIG. 12C is obtained.

In the present embodiment, since the two conductors are used and the output signals from the respective conductors are added, as described above, the direction and magnitude of image shift can be determined not based on the value of potential change, but based on a difference between signal waveforms, which facilitates detection of an image shift.

A position shift in the sub scanning direction can be detected based on a signal interval of induced current as in the first embodiment.

Color shifts in the main scanning direction and the sub scanning direction are corrected by the same color shift correction method as that employed in the first embodiment.

In the third embodiment, since the two conductors provided separately are disposed in overlapping relation, the number of component parts increases, which requires difficult work for accurate assembly. To solve this problem, in a fourth embodiment, conductors 20 and 22 are used with respective comb tooth parts 23 and 25 in mesh with each other. Reference numerals 19 and 21 denote respective comb teeth support portions.

Figure 14A:
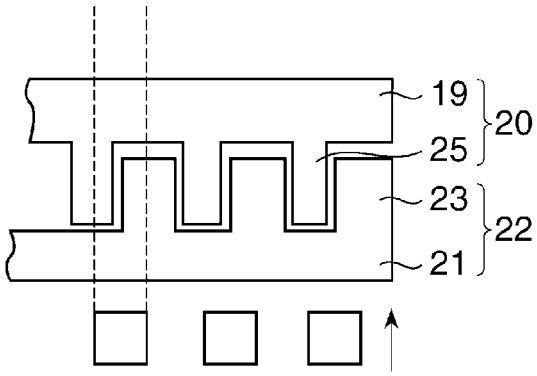
FIGS. 14A to 14C are views each showing the positional relationship between an electrostatic latent image line and the conductors in the fourth embodiment.
Figure 14B:
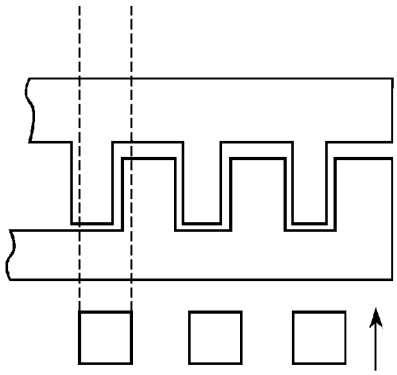
Figure 14C:
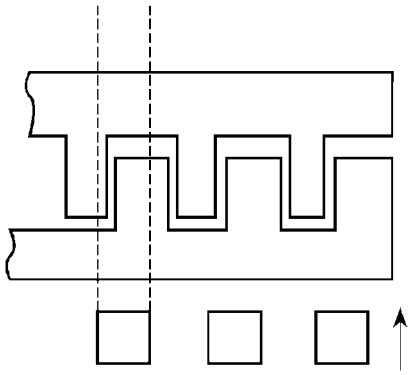

To be more specific, FIGS. 14A to 14C are views showing the positional relationship between the electrostatic latent image line 7 and the conductors 20 and 22, in which FIG. 14A illustrates a case where the electrostatic latent image line 7 is not shifted in the main scanning direction, FIG. 14B illustrates a case where the electrostatic latent image line 7 is shifted leftward, and FIG. 14C illustrates a case where the electrostatic latent image line 7 is shifted rightward.

Figure 15A:
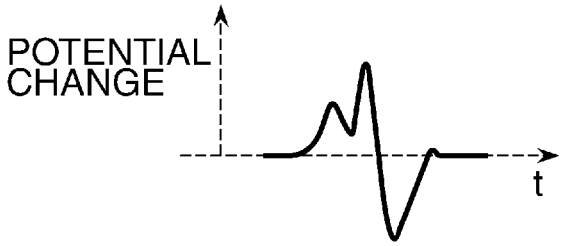
FIGS. 15A to 15C are diagrams showing potential changes in the fourth embodiment (1).

The conductors 20 and 22 are disposed such that the comb tooth parts thereof partially overlap the electrostatic latent image line 7 while moving relative to the electrostatic latent image line 7. In the case illustrated in FIG. 14A, during passage of an electrostatic latent image line 7 before the conductors 20 and 22, a signal output from the conductor 20 is as shown in FIG. 15A, and a signal obtained by inverting an output signal from the conductor 22 is as shown in FIG. 16A.

Figure 15B:
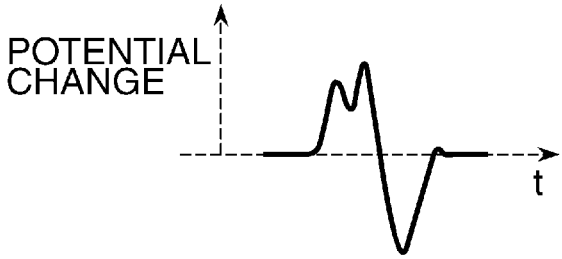
Figure 15C:
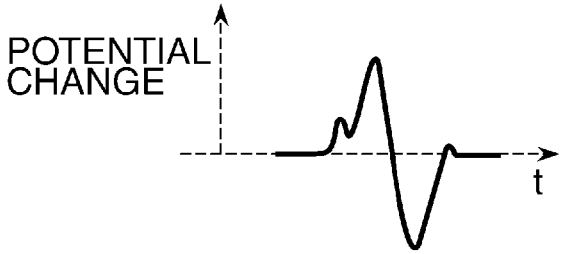
Figure 16A:
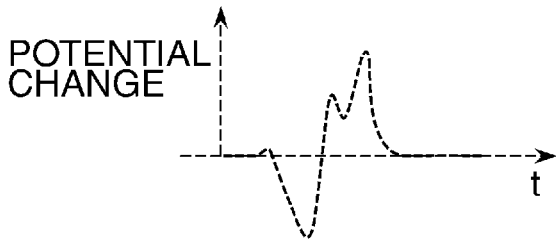
FIGS. 16A to 16C are diagrams potential changes in the fourth embodiment (2).
Figure 16B:
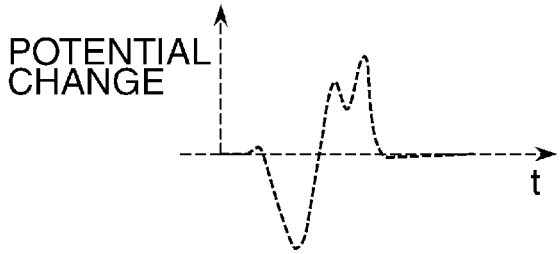
Figure 16C:
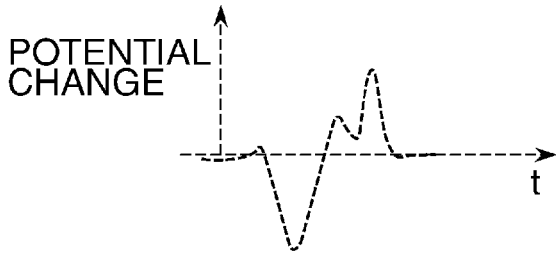
Figure 17A:
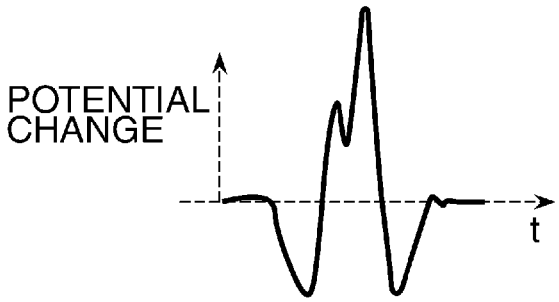
FIGS. 17A to 17C are diagrams showing potential changes obtained by adding the potential changes in FIGS. 15A to 15C and the potential changes in FIGS. 16A to 16C, respectively.

The vertical axis in each of FIGS. 15A to 15C, FIGS. 16A to 16C, and FIGS. 17A to 17C represents potential change, and the horizontal axis represents time. The electrostatic latent image line 7 starts to pass the comb tooth parts 25 of the conductor 20 in timing in which passage of the electrostatic latent image line 7 across the comb teeth support portion 21 of the conductor 22 is completed, and therefore a first crest in FIG. 15A and a first crest in FIG. 16A coincide in timing with each other. When the signal in FIG. 15A and the signal in FIG. 16A are added, a waveform representing potential change, as shown in FIG. 17A, is obtained.

On the other hand, in the case illustrated in FIG. 14B, since the electrostatic latent image line 7 is shifted leftward, the length of overlap between the electrostatic latent image line 7 and the comb tooth parts 25 of the conductor 20 increases, and therefore the potential change having the first crest is larger than in the case where there is no shift (see FIG. 15B).

Further, the length of overlap between the electrostatic latent image line 7 and the comb tooth parts 23 of the conductor 22 decreases, but the length of the same at the time of completion of passage across the support portion 21. Therefore, the potential change having the first crest in FIG. 16B is larger.

Figure 17B:
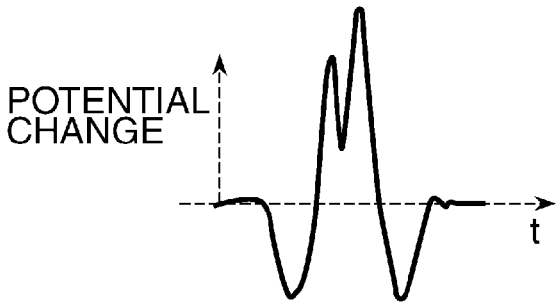

The relationship in time between FIG. 15B and FIG. 16B is identical to that between FIG. 15A and FIG. 16A. Therefore, when the signals in FIGS. 15B and 16B are added, a waveform shown in FIG. 17B is obtained. In FIG. 17B, the potential change having the first crest is larger than in the FIG. 17A case where there is no position shift.

On the other hand, in the case illustrated in FIG. 14C, since the electrostatic latent image line 7 is shifted rightward, the length of overlap between the electrostatic latent image line 7 and the comb tooth parts 25 of the conductor 20 decreases, and therefore the potential change having the first crest is smaller than in the case where there is no shift (see FIG. 15C).

Further, since the length of overlap between the electrostatic latent image line 7 and the comb tooth parts 23 of the conductor 22 increases, the length of portions of the comb teeth support portion 21 across which the electrostatic latent image line 7 passes but from which no comb tooth parts 23 continue decreases, and therefore the potential change having the first crest in FIG. 16C is smaller.

Figure 17C:
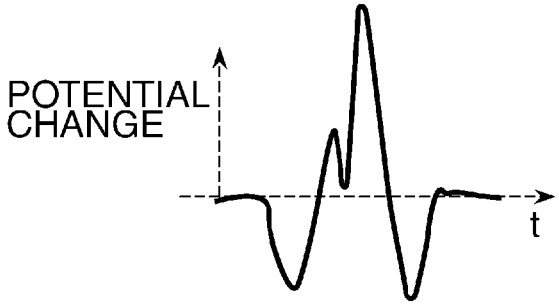

The relationship in time between FIG. 15C and FIG. 16C is identical to that between FIG. 15A and FIG. 16A. Therefore, when the signals in FIGS. 15C and 16C are added, a waveform shown in FIG. 17C is obtained. In FIG. 17C, the potential change having the first crest is smaller than in the FIG. 17A case where there is no position shift.

As described above, the direction and magnitude of image shift can be detected by disposing the two conductors such that the comb-tooth parts of one conduction and those of the other conductor are arranged in a mated fashion, and adding the output signals from the respective conductors. In the present embodiment, an output signal is amplified by using the two conductors, differently from the second embodiment, so that it is possible to detect an image shift even when noise is large.

A position shift in the sub scanning direction can be detected based on a signal interval of induced current as in the first embodiment.

Color shifts in the main scanning direction and the sub scanning direction are corrected by the same color shift correction method as that employed in the first embodiment.

The method of the second embodiment makes it possible to detect the slightest image shift in the main scanning direction. However, as shown in FIGS. 5A and 5B and 6A to 6C, the conductor 9 has the comb teeth support portion 11. Therefore, when the electrostatic latent image line 7 passes the comb teeth support portion 11, the electrostatic latent image line 7 passes across the conductor 9 irrespective of the direction of image shift, so that values of potential change substantially equal to each other are detected, as is apparent e.g. from respective second crests and troughs of potential changes in FIGS. 7A to 7C.

Figure 18A:
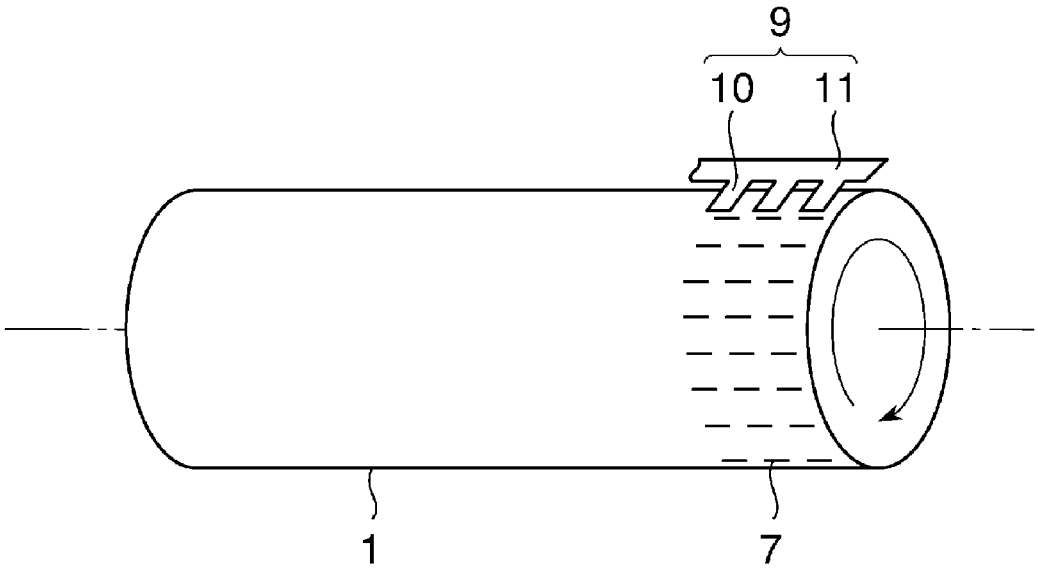
FIGS. 18A and 18B are views showing the positional relationship between a conductor and an image carrier in an image forming apparatus according to a fifth embodiment of the present invention.
Figure 18B:
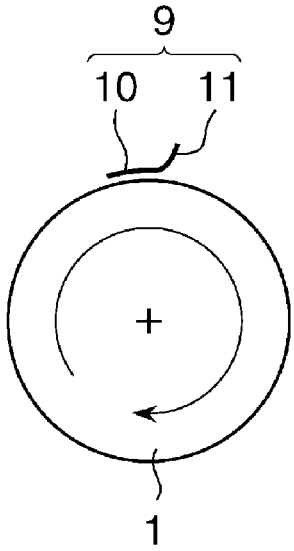

FIGS. 18A and 18B are views showing the positional relationship between a conductor and an image carrier in an image forming apparatus according to a fifth embodiment of the present invention. FIG. 18A is a front perspective view, and FIG. 18B a side view.

In the present embodiment, the comb teeth support portion 11 of the conductor 9 is fixed with a distance from the photosensitive drum 1, as shown in FIG. 18B, so as not to be easily influenced by a charge of an electrostatic latent image line 7. Specifically, in the present embodiment, the conductor 9 is bent such that the comb teeth support portion 11 is held away from the surface of the photosensitive drum 1.

Figure 19A:
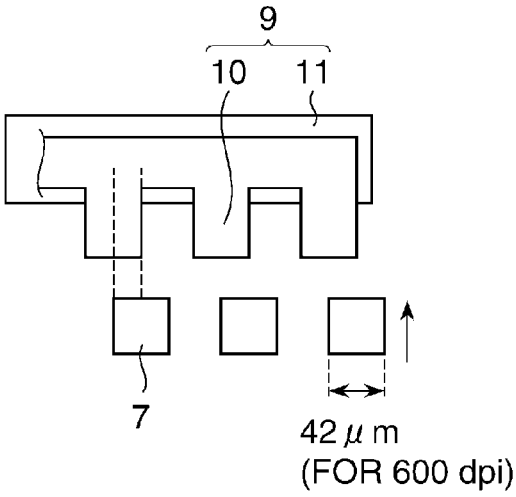
FIGS. 19A to 19C are views each showing the positional relationship between an electrostatic latent image line and the conductor in the fifth embodiment.

The conductor 9 will be described in detail with reference to FIGS. 19A to 19C. FIG. 19A illustrates a case where the electrostatic latent image line 7 is not shifted in the main scanning direction, FIG. 19B illustrates a case where the electrostatic latent image line 7 is shifted leftward, and FIG. 19C illustrates a case where the electrostatic latent image line 7 is shifted rightward.

Figure 19B:
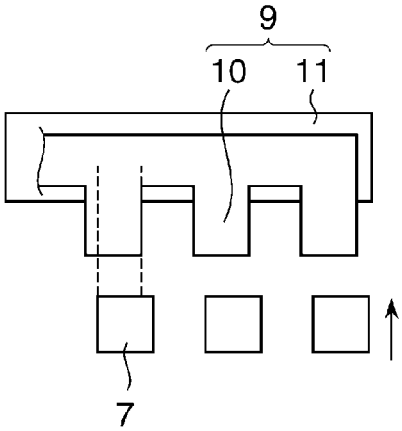
Figure 19C:
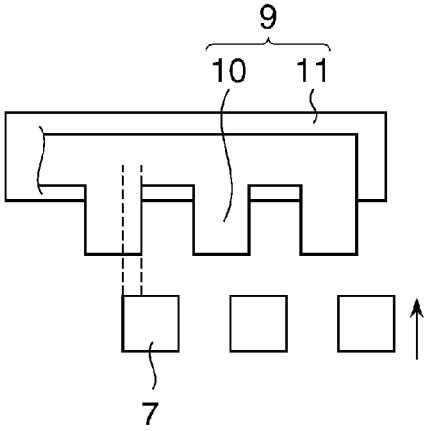

The comb teeth support portion 11 in each of FIGS. 19A to 19C is held away from the electrostatic latent image line 7 as shown in FIG. 18B, and therefore it can be considered that induced current is hardly generated by the comb teeth support portion 11 and the electrostatic latent image line 7.

Figure 20A:
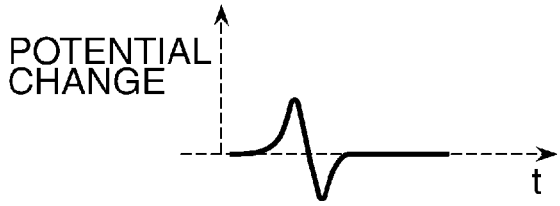
FIGS. 20A to 20C are diagrams showing potential changes in the fifth embodiment.
Figure 20B:
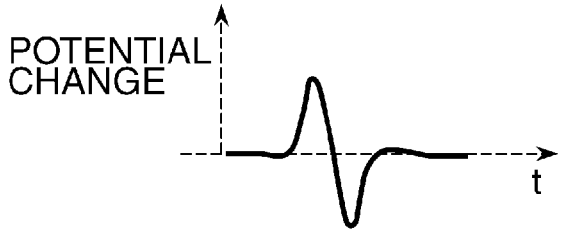
Figure 20C:
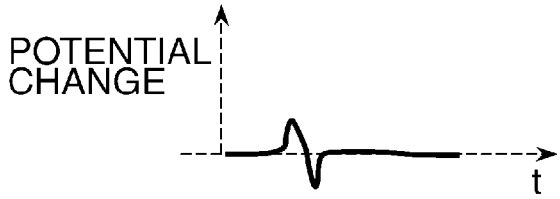

FIGS. 20A to 20C show potential changes caused by the relationship between the electrostatic latent image line 7 and the comb tooth parts 10 alone.

The conductor 9 is disposed such that the comb tooth parts 10 thereof partially overlap the electrostatic latent image line 7 while moving relative to the electrostatic latent image line 7. In a case illustrated in FIG. 19A, a potential change detected by the conductor 9 during passage across an electrostatic latent image line 7 is as shown in FIG. 20A.

On the other hand, in a case illustrated in FIG. 19B, since the electrostatic latent image line 7 is shifted leftward, the length of overlap between the electrostatic latent image line 7 and the comb tooth parts 10 of the conductor 20 increases, and therefore the potential change is larger than in the case where there is no shift (see FIG. 20B).

Further, in a case illustrated in FIG. 19C, since the electrostatic latent image line 7 is shifted rightward, the length of overlap between the electrostatic latent image line 7 and the comb tooth parts 10 of the conductor 9 decreases, and therefore the potential change is smaller than in the case where there is no shift (see FIG. 20C).

When the comb teeth support portion 11 of the conductor 9 is influenced by a charge of the electrostatic latent image line 7 as in FIGS. 5A and 5B, the values of the second crests of the respective potential changes in FIGS. 7A to 7C become approximately equal to each other irrespective of image shift in the main scanning direction, and so do the values of the respective crests.

However, when the comb teeth support portion 11 is fixed such that the same is not easily influenced by the charge of the electrostatic latent image line 7, it is possible to detect only a varying portion of the potential as a waveform, as shown in each of FIGS. 20A to 20C.

The present embodiment can be applied to the third and fourth embodiments as well, to thereby detect a varying portion of the potential as a waveform.

A position shift in the sub scanning direction can be detected based on a signal interval of induced current as in the first embodiment.

Further, color shifts in the main scanning direction and the sub scanning direction are corrected by the same color shift correction method as that employed in the first embodiment.

In the fourth embodiment, the comb teeth support portions 19 and 21 are fixed without being bent away from the photosensitive drum 1. The following description is given of a method of preventing the comb teeth support portions 19 and 21 from being easily influenced by the charge of the electrostatic latent image line 7, which is employed in a sixth embodiment of the present invention.

Figure 21:
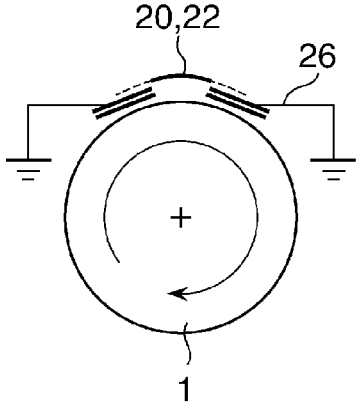
FIG. 21 is a view showing the positional relationship between conductors, an image carrier, and a ground slit piece in an image forming apparatus according to a sixth embodiment of the present invention.
Figure 22:
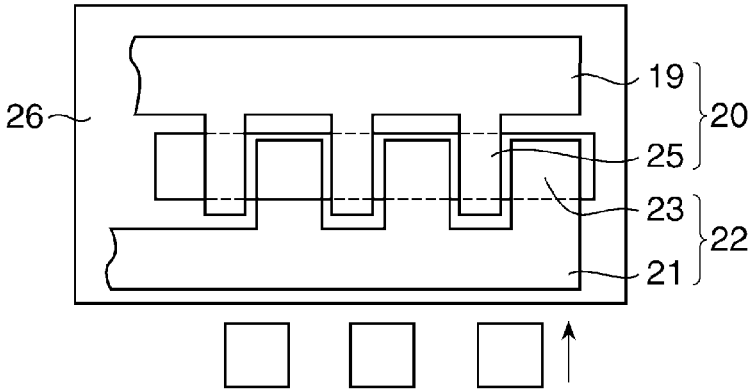
FIG. 22 is a view showing the positional relationship between an electrostatic latent image line, the conductors, and the ground slit piece in the sixth embodiment.
Figure 23:
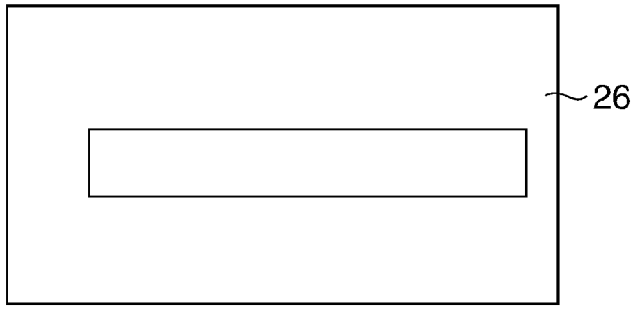
FIG. 23 is a view showing the shape of the ground slit piece in the sixth embodiment.

In this method, a thin film conductor 26 (hereinafter referred to as "the ground slit piece") formed with a slit as shown in FIG. 23 is provided, and the ground slit piece 26 is fixed in such a positional relation to conductors 20 and 22 as shown in FIGS. 21 and 22.

As shown in FIG. 21, the conductors 20 and 22 are opposed to the photosensitive drum 1 through the slit of the ground slit piece 26. Since the ground slit piece 26 is thus disposed, it can be considered that induced current is hardly generated between the comb teeth support portions 19 and 21 and the electrostatic latent image line 7.

Figure 13:
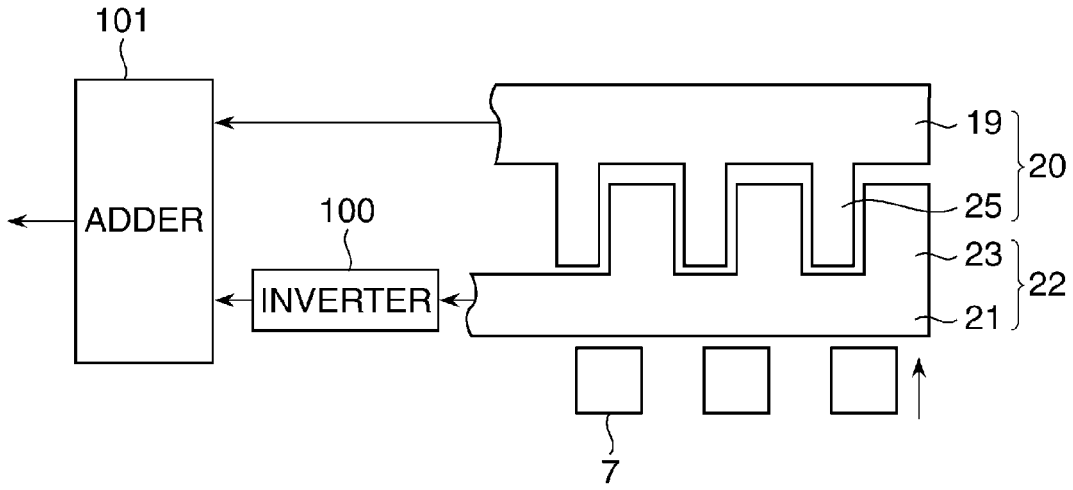
FIG. 13 is a view showing conductors in an image forming apparatus according to a fourth embodiment of the present invention.
Figure 24A:
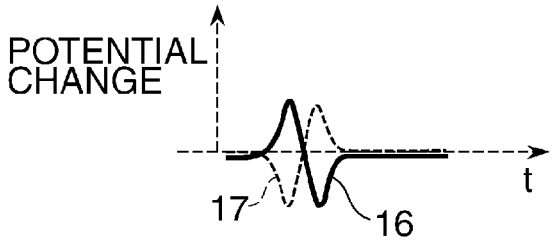
FIGS. 24A to 24C are diagrams showing potential changes in the sixth embodiment.
Figure 24B:
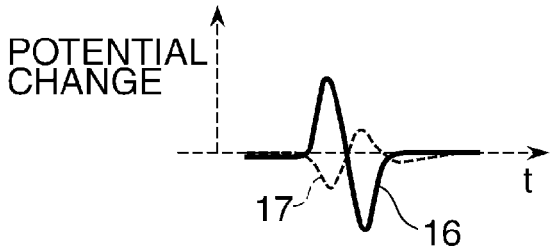
Figure 24C:
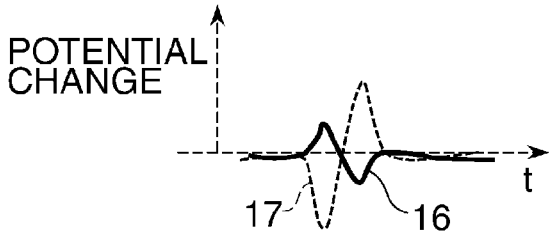

FIGS. 24A to 24C show only potential changes that occur in the relationship between the comb tooth parts 25 and the electrostatic latent image line 7 and between the comb tooth parts 23 and the electrostatic latent image line 7. The conductors 20 and 22 and the electrostatic latent image line 7 are positioned as shown in FIGS. 14A to 14C in the fourth embodiment. Further, as in the fourth embodiment, the two kinds of conductors 20 and 22 are provided, as shown in FIG. 13, to thereby form a circuit in which an output signal obtained from the conductor 22 is inverted and is added to an output signal from the conductor 20.

Figure 25A:
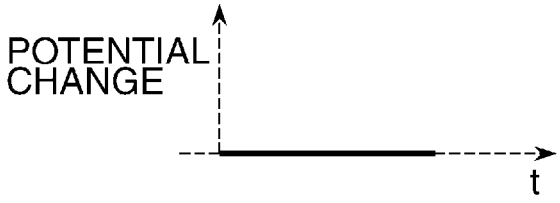
FIGS. 25A to 25C are diagrams showing potential changes obtained by adding outputs from the respective two conductors in the sixth embodiment.

FIG. 24A shows potential change signals output from the respective conductors 20 and 22 in a case where there is no position shift in the main scanning direction. A signal output from the conductor 20 during passage of the electrostatic latent image line 7 before the conductor 20 is denoted by 16 in FIG. 24A, and a signal obtained by inverting an output signal from the conductor 22 during passage of the electrostatic latent image line 7 before the conductor 22 is denoted by 17 in the same. When the signal 16 and the signal 17 are added, the value of the signal indicative of potential change becomes equal to 0 as shown in FIG. 25A.

On the other hand, in a case shown in FIG. 24B, since the electrostatic latent image line 7 is shifted leftward, the length of overlap between the electrostatic latent image line 7 and the comb tooth parts 25 of the conductor 20 increases, and therefore the potential change is larger than in the case where there is no shift (see the signal 16 in FIG. 24B).

Figure 25B:
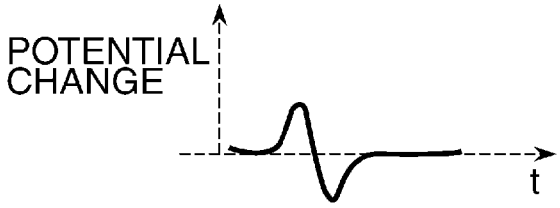

On the other hand, the length of overlap between the electrostatic latent image line 7 and the comb tooth parts 23 of the conductor 22 decreases, and therefore the potential change is smaller than in the case where there is no shift (see the signal 17 in FIG. 24B). When the signal 16 and the signal 17 are added, a waveform shown in FIG. 25B is obtained.

Further, in a case shown in FIG. 24C, the electrostatic latent image line 7 is shifted rightward, and therefore the length of overlap between the electrostatic latent image line 7 and the comb tooth parts 25 of the conductor 20 during the relative motion decreases. As a consequence, the potential change becomes smaller (see the signal 16 in FIG. 24C).

Figure 25C:
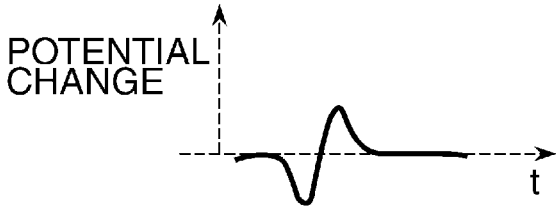

On the other hand, the length of overlap between the electrostatic latent image line 7 and the comb tooth parts 23 of the conductor 22 increases, and therefore the potential change value becomes larger (see the signal 17 in FIG. 24C). When the signal 16 and the signal 17 are added, a waveform shown in FIG. 25C is obtained.

As described above, by providing the ground slit piece 26 between the photosensitive drum 1 and the conductors 20 and 22, the same result (extraction of only a varying portion of the potential change) as obtained in the fifth embodiment can be obtained. Further, the present embodiment can be applied to the second and third embodiments as well to thereby detect only a varying portion of the potential as a waveform.

A position shift in the sub scanning direction can be detected based on a signal interval of induced current as in the first embodiment.

Further, color shifts in the main scanning direction and the sub scanning direction are corrected by the same color shift correction method as that employed in the first embodiment.

Figure 26A:
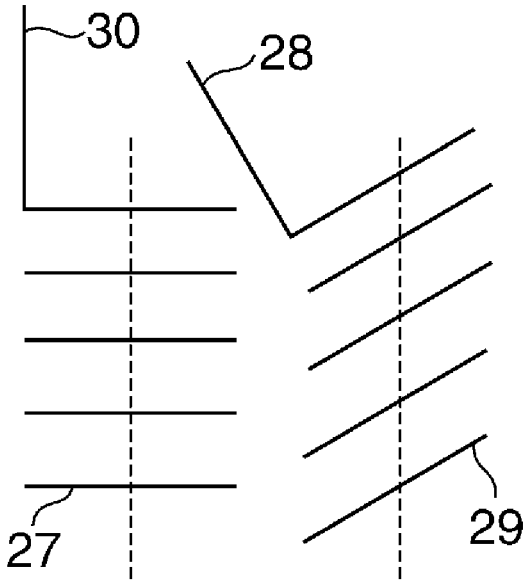
FIGS. 26A and 26B are views each showing the positional relationship between electrostatic latent image lines and conductors in an image forming apparatus according to a seventh embodiment of the present invention.
Figure 26B:
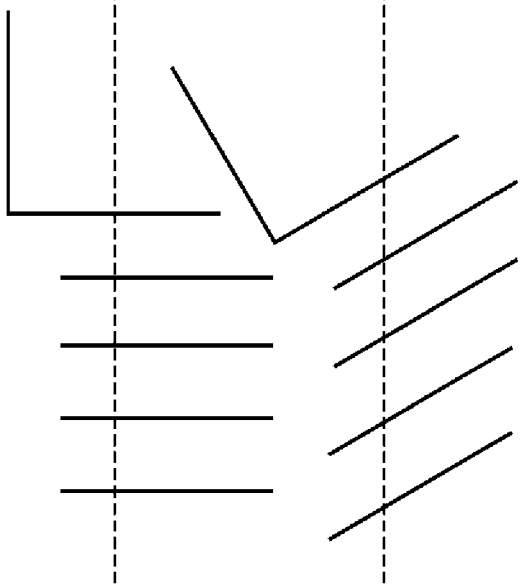

In a seventh embodiment, as shown in FIGS. 26A and 26B, first electrostatic latent image lines 27 are formed in parallel with each other in an exposure scanning direction (main scanning direction). In addition, second electrostatic latent image lines 29 are formed obliquely in parallel in the exposure scanning direction, and a first conductor 30 and a second conductor 28 are disposed in parallel relation to the first electrostatic latent image lines 27 and the second electrostatic latent image lines 29, respectively. The direction and magnitude of position shift in the main scanning direction are detected based on a phase difference between output signals (a first output signal and a second output signal) output from the respective conductors.

Figure 27A:
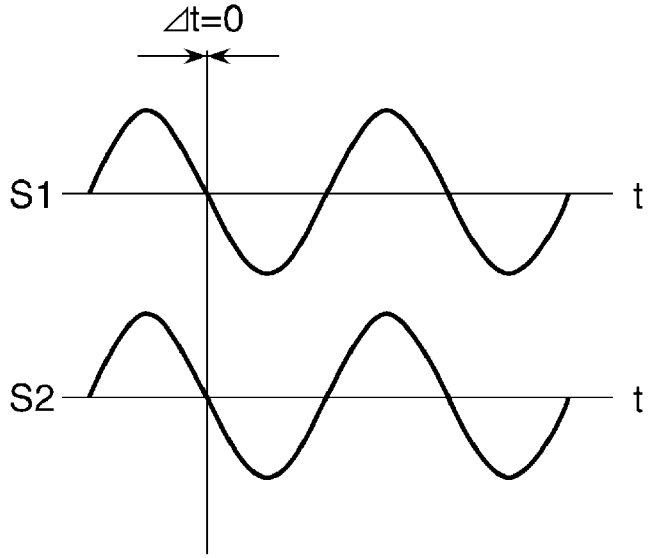
FIGS. 27A and 27B are diagrams showing potential changes in the seventh embodiment.

In FIG. 26B, the electrostatic latent image lines 27 and 29 are shifted rightward in the main scanning direction with respect to positions thereof in FIG. 26A. In the case illustrated in FIG. 26A, signals detected during passage of the conductors 30 and 28 across respective associated ones of the electrostatic latent image lines 27 and 29 are in the same phase as shown in FIG. 27A.

Figure 27B:
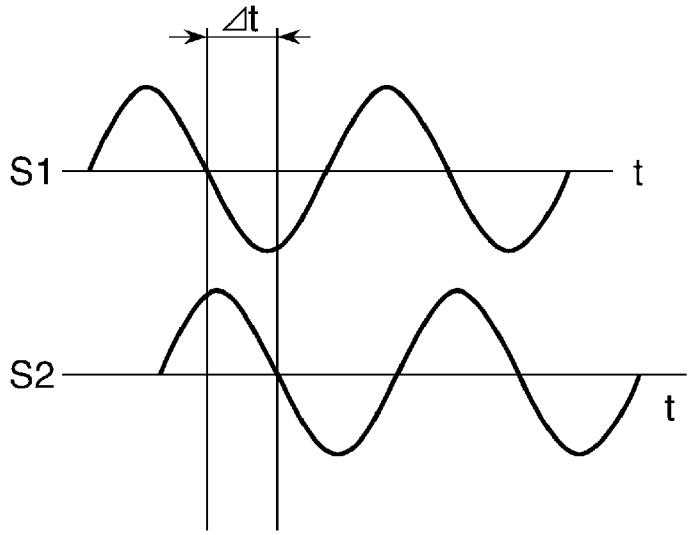

However, in the FIG. 26B case where the electrostatic latent image lines 27 and 29 are shifted rightward, the output signal from the conductor 28 is detected with delay with respect to the output signal from the conductor 30, as shown in FIG. 27B.

Thus, detection start times when the output signals are output from the respective two conductors are compared, whereby it is possible to detect the direction and magnitude of image shift in the main scanning direction.

A position shift in the sub scanning direction can be detected based on a signal interval of induced current as in the first embodiment.

Further, color shifts in the main scanning direction and the sub scanning direction are corrected by the same color shift correction method as that employed in the first embodiment.

Next, a description will be given of an eighth embodiment of the present invention. In the present embodiment, a conductor and electrostatic latent image lines described in one of the first to seventh embodiments are provided on each of the opposite ends of the photosensitive drum 1. This makes it possible to detect the direction and magnitude of image shift on the opposite ends of the photosensitive drum 1 to thereby detect image magnification in the main scanning direction.

Further, by detecting the pitch of the electrostatic latent image lines in the sub scanning direction on each of the opposite ends of the photosensitive drum 1, it is also possible to detect the inclination of a laser beam with respect to the exposure scanning direction or the inclination of the image carrier in a plane formed by tangent lines on the photosensitive drum which are parallel to the conductors disposed on the respective opposite ends of the photosensitive drum.

Figure 28:
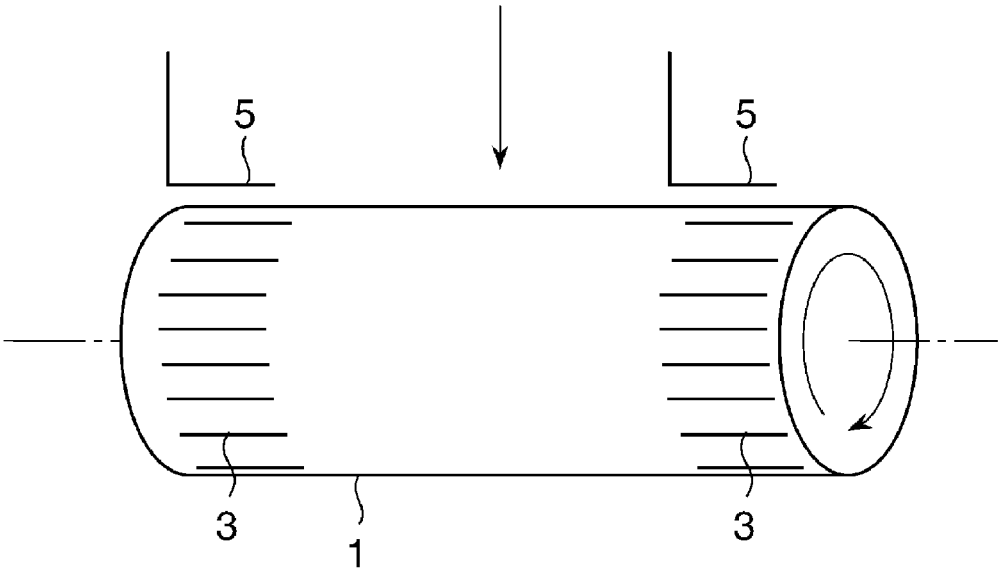
FIG. 28 is a view showing the positional relationship between electrostatic latent image lines, conductors, and an image carrier in an image forming apparatus according to an eighth embodiment of the present invention.
Figure 29:
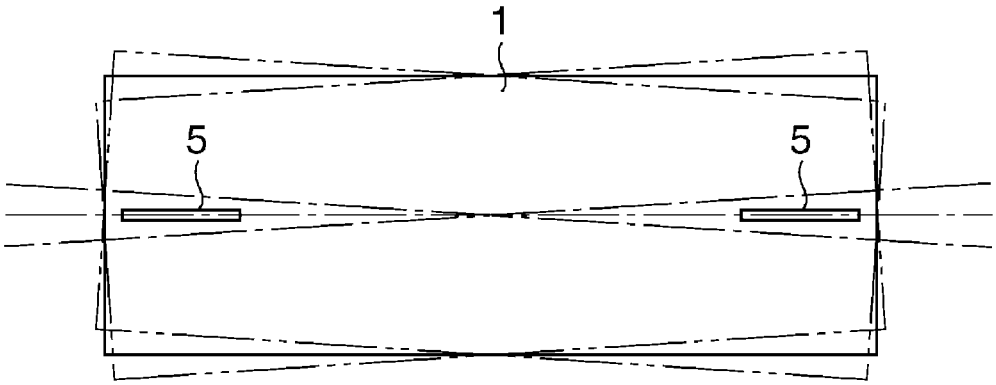
FIG. 29 is a view showing an inclination of the image carrier in the eighth embodiment.

FIG. 28 is a view showing the positional relationship between the electrostatic latent image lines, the conductors, and the image carrier in an image forming apparatus according to the eighth embodiment of the present invention. FIG. 29 is a view as viewed in a direction indicated by an arrow in FIG. 28.

In a case where the electrostatic latent image lines 3 are formed on the opposite ends of the photosensitive drum 1 and the conductors 5 are disposed in facing relation to the respective opposite ends of the photosensitive drum 1 as shown in FIG. 28, comparison between the intervals of signals output from the respective conductors 5 makes it possible to detect a tilted state of the photosensitive drum 1 as shown by phantom lines in FIG. 29.

Although in any of the above-described first to eighth embodiments, potential change is measured on the photosensitive drum by the one or two conductors, this is not limitative, but measurement of potential change may also be performed on the intermediate transfer belt which is brought into contact with the photosensitive drum or the sheet conveyor belt.

According to the above-described first to eighth embodiments, it is possible to detect the direction and magnitude of image shift in the main scanning direction as well as in the sub scanning direction. Further, by controlling both or one of the photosensitive drum and the belts in the laser light irradiation position or the transfer position based on the detected direction and magnitude of image shift, it is possible to correct color shift substantially on a real-time basis.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-031321, filed Feb. 13, 2009, and Japanese Patent Application No. 2010-027605, filed Feb. 10, 2010, which are hereby incorporated by reference herein in its entirety.

What is claimed is:

1. An image forming apparatus comprising:

a conductor disposed such that said conductor partially overlaps an electrostatic latent image line formed on an image carrier in a manner extending in a main scanning direction of the image carrier, while performing relative motion to the electrostatic latent image line, said conductor being configured to generate induced current by the relative motion; and a detection unit configured to detect image shift in the main scanning direction based on a result of measurement of the induced current generated by said conductor.

2. The image forming apparatus according to claim 1, wherein the electrostatic latent image line is a dotted line with a dot pitch substantially corresponding to a resolution of the image forming apparatus, and said conductor includes comb-tooth parts arranged at a pitch substantially identical to the dot pitch of the electrostatic latent image line.

3. The image forming apparatus according to claim 2, wherein said conductor comprises two conductors disposed in parallel to each other such that said comb-tooth parts do not overlap each other, and an output signal from one of said two conductors is inverted to be added to an output signal from the other of said conductors.

4. The image forming apparatus according to claim 2, wherein said conductor comprises two conductors disposed such that said comb-tooth parts are arranged in a mated fashion, and an output signal from one of said two conductors is inverted and then added to an output signal from the other of said conductors.

5. The image forming apparatus according to claim 2, wherein a comb teeth support portion that supports said comb-tooth parts is fixed with a distance which ensures that said comb teeth support portion is less influenced by a charge of the electrostatic latent image line than said comb-tooth parts are.

6. The image forming apparatus according to claim 5, further including a conductor connected to a ground, between said comb teeth support portion that supports said comb-tooth parts and the image carrier.

7. The image forming apparatus according to claim 1, wherein the electrostatic latent image line and said conductor are provided at each of opposite ends of the image carrier.

8. The image forming apparatus according to claim 1, wherein at least one of the image carrier or a transfer belt at at least one of a laser light irradiation position or a transfer position is controlled based on an amount of the detected image shift.

9. The image forming apparatus according to claim 1, wherein a plurality of the electrostatic latent image lines are formed in a sub scanning direction at predetermined intervals, and said detection unit also detects an image shift in the sub scanning direction, based on intervals of generation of the induced current by said conductor.

10. An image forming apparatus comprising:

a first conductor disposed in parallel to a first electrostatic latent image line formed on an image carrier in parallel with a main scanning direction of the image carrier; and a second conductor disposed in parallel to a second electrostatic latent image line formed on the image carrier obliquely in the main scanning direction, wherein induced current is generated by moving said conductors relative to the respective electrostatic latent image lines, and image shifts in the main scanning direction and a sub scanning direction are detected based on a phase difference between a first output signal from said first conductor and a second output signal from said second conductor.

11. The image forming apparatus according to claim 10, wherein the electrostatic latent image lines and said conductors are provided at each of opposite ends of the image carrier.

12. The image forming apparatus according to claim 10, wherein at least one of the image carrier or a transfer belt at at least one of a laser light irradiation position or a transfer position is controlled based on an amount of the detected image shift.

13. The image forming apparatus according to claim 10, wherein a plurality of the electrostatic latent image lines are formed in the sub scanning direction at predetermined intervals, and an image shift in the sub scanning direction is also detected based on intervals of generation of the induced current by at least one of said first conductor or said second conductor.

14. An image forming apparatus comprising:

a rotatable image carrier on which an electrostatic latent image line is formed;

a conductor disposed such that said conductor partially overlaps the electrostatic latent image line formed on said image carrier, said conductor being configured to generate induced current that changes according to a position in a main scanning direction orthogonal to a sub scanning direction in which said image carrier performs rotation, where the electrostatic latent image line is formed;

a detection unit configured to detect the induced current generated in said conductor; and a correction unit configured to correct a position shift of an image formed on said image carrier, in the main scanning direction, based on the induced current detected by said detection unit.

15. The image forming apparatus according to claim 14, wherein said correction unit corrects the position shift in the main scanning direction based on an amplitude of the induced current and corrects the position shift in the sub scanning direction based on timing of generation of the induced current.

16. The image forming apparatus according to claim 14, wherein the electrostatic latent image line is formed in a manner extending in the main scanning direction, and said conductor is disposed in parallel to the electrostatic latent image line.

* * * * *